US006386155B2

(12) United States Patent
Moriya et al.

(10) Patent No.: US 6,386,155 B2
(45) Date of Patent: May 14, 2002

(54) INTERNAL COMBUSTION ENGINE VARIABLE VALVE CHARACTERISTIC CONTROL APPARATUS AND THREE-DIMENSIONAL CAM

(75) Inventors: Yoshihito Moriya, Nagoya; Shinichiro Kikuoka, Nishikamo-gun; Shuuji Nakano, Nagoya; Hideo Nagaosa, Nishikamo-gun, all of (JP)

(73) Assignee: Toyota Jidosha Kabushkik Kaisha, Tokyo (JP)

( * ) Notice: Subject to any disclaimer, the term of this patent is extended or adjusted under 35 U.S.C. 154(b) by 0 days.

(21) Appl. No.: 09/962,682

(22) Filed: Sep. 26, 2001

Related U.S. Application Data

(62) Division of application No. 09/506,958, filed on Feb. 18, 2000.

(30) Foreign Application Priority Data

Mar. 10, 1999 (JP) ..... 11-063468

(51) Int. Cl.[7] ..... F01L 1/00
(52) U.S. Cl. ..... 123/90.1
(58) Field of Search ..... 123/90.1, 90.11, 123/90.15, 90.17, 90.18

(56) References Cited

U.S. PATENT DOCUMENTS

| | | | | |
|---|---|---|---|---|
| 1,688,164 A | | 10/1928 | Tarrant | |
| 4,753,198 A | | 6/1988 | Heath | |
| 5,080,055 A | * | 1/1992 | Komatsu et al. | 123/90.11 |
| 5,870,984 A | | 2/1999 | Hasegawa et al. | |
| 5,893,345 A | * | 4/1999 | Sugimoto et al. | 123/90.15 |
| 5,924,397 A | * | 7/1999 | Moriya et al. | 123/90.17 |
| 6,170,448 B1 | | 1/2000 | Asakura | |
| 6,230,675 B1 | | 5/2000 | Kobayashi et al. | |
| 6,298,813 B1 | * | 1/2001 | Asakura et al. | 123/90.17 |

FOREIGN PATENT DOCUMENTS

| | | |
|---|---|---|
| FR | 2 289 734 A | 5/1976 |
| GB | 215 967 A | 5/1924 |
| GB | 1 296 157 A | 11/1972 |
| JP | 61 234209 A | 10/1986 |

* cited by examiner

*Primary Examiner*—Teresa Walberg
*Assistant Examiner*—Vinod Patel
(74) *Attorney, Agent, or Firm*—Oliff & Berridge, PLC

(57) ABSTRACT

Variable valve characteristic control apparatuses realize a change in a valve characteristic in accordance with a requirement of an internal combustion engine and a three-dimensional cam for use in the variable valve characteristic control apparatus. In the case of an intake valve, two lift patterns and continuously varying lift patterns between the two lift patterns are realized by the three-dimensional cam through the driving of the variable valve characteristic control apparatus. The two lift patterns provide different amounts of lift in the delay side of a peak within a valve operation angle, but provide equal amounts of lift in the delay side of the peak. Since the intake cam has the two lift patterns, it is possible to select a phase where the two lift patterns provide equal amounts of lift and provide different amounts of lift in phases other than the equal-lift phase so as to accord to the characteristics of the internal combustion engine. Therefore, it is possible to achieve conformation to the characteristics of the engine and therefore constantly realize a suitable valve characteristic in accordance with the operational condition of the engine. Hence, improvements can be achieved in the output performance of the engine, the fuel consumption, the combustion stability and the like.

10 Claims, 21 Drawing Sheets

INTERNAL COMBUSTION ENGINE VARIABLE VALVE CHARACTERISTIC CONTROL APPARATUS AND THREE-DIMENSIONAL CAM

INCORPORATION BY REFERENCE

This is a Division of application Ser. No. 09/506,958 filed Feb. 18, 2000. The entire disclosure of the prior application (s) is hereby incorporated by reference herein in its entirety.

The disclosure of Japanese Patent Application No. HEI 11-63468 filed on Mar. 10, 1999 including the specification, drawings and abstract is incorporated herein by reference in its entirety.

BACKGROUND OF THE INVENTION

1. Field of the Invention

The present invention relates to an internal combustion engine variable cam characteristic control apparatus that changes the valve characteristics of one or both of an intake valve and an exhaust valve through the use of a cam by changing the profile of the cam between two lift patterns, and a three-dimensional cam for use in the control apparatus.

2. Description of the Related Art

A variable engine valve driver which suitably controls the engine characteristic by changing the operation angle or the amount of lift of an intake valve or an exhaust valve in accordance with the operating condition of an internal combustion engine is known (disclosed in, for example, U.S. Pat. No. 5,870,984).

This apparatus adopts a three-dimensional cam provided on the camshaft, and adjusts the position of the camshaft in directions of the rotating axis of the camshaft so as to continuously change the cam profile, thereby achieving a proper operation angle and a proper amount of lift.

The aforementioned three-dimensional cam has a cam profile as indicated by the graph in FIG. 34. The valve characteristic of the three-dimensional cam is adjusted by continuously changing the cam profile between a pattern having a small peak of lift and a pattern having a simply increased total amount of lift as indicated by solid lines in the graph of FIG. 34. For an increase in the valve lift (a change from a small-peak pattern to a great-peak pattern), the valve operation angle is expanded forward and rearward, so that the valve opening timing advances and the valve closing timing delays. Conversely, for a decrease in the valve lift (a change from a great-peak pattern to a small-lift pattern), the valve operation angle is reduced so that the valve opening timing delays and the valve closing timing advances.

However, this simple manner of changing the valve characteristic does not have sufficient flexibility to adapt to various characteristic requirements of internal combustion engines and, in some cases, fails to sufficiently contribute to a desired engine performance improvement.

SUMMARY OF THE INVENTION

Accordingly, it is an object of the invention to provide a variable valve characteristic control apparatus that achieves a change in the valve characteristic in accordance with a requirement of an internal combustion engine and provide a three-dimensional cam for use in the control apparatus.

To achieve the aforementioned and other objects, a variable valve characteristic control apparatus of an internal combustion engine according to an aspect of the invention includes a cam having a cam profile that varies at least between a first lift pattern and a second lift pattern, and a controller that controls a valve characteristic of at least one of an intake valve and an exhaust valve of the internal combustion engine by adjusting a position of the cam in a direction of a rotating axis of the cam. The first lift pattern and the second lift pattern provide equal amounts of lift at least at a phase within a valve operation angle.

A three-dimensional cam for use for at least one of an intake valve and an exhaust valve of an internal combustion engine has a cam profile that continuously varies between a first lift pattern and a second lift pattern that provides an amount of lift equal to an amount of lift provided by the first lift pattern at least at a phase within a valve operation angle.

Therefore, the three-dimensional cam achieves, for at least one of the intake valve and the exhaust valve, different amounts of lift at a portion of a valve operation angle and equal amounts of lift at another portion of the valve operation angle. That is, within the valve operation angle, there exists a phase where the amount of lift remains unchanged despite a change of the operating cam profile. Therefore, it becomes possible to select a phase where various cam profiles provide equal amounts of lift and set different amounts of lift occurring at the other phases in accordance with the characteristics of the internal combustion engine.

As a result, it becomes possible to realize a suitable valve characteristic in accordance with a requirement of an internal combustion engine. Therefore, further improvements can be achieved in the output performance of the internal combustion engine, the fuel consumption, the combustion stability, and the like.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENTS

Preferred embodiments of the invention will be described hereinafter with reference to the accompanying drawings.

Figure 1:
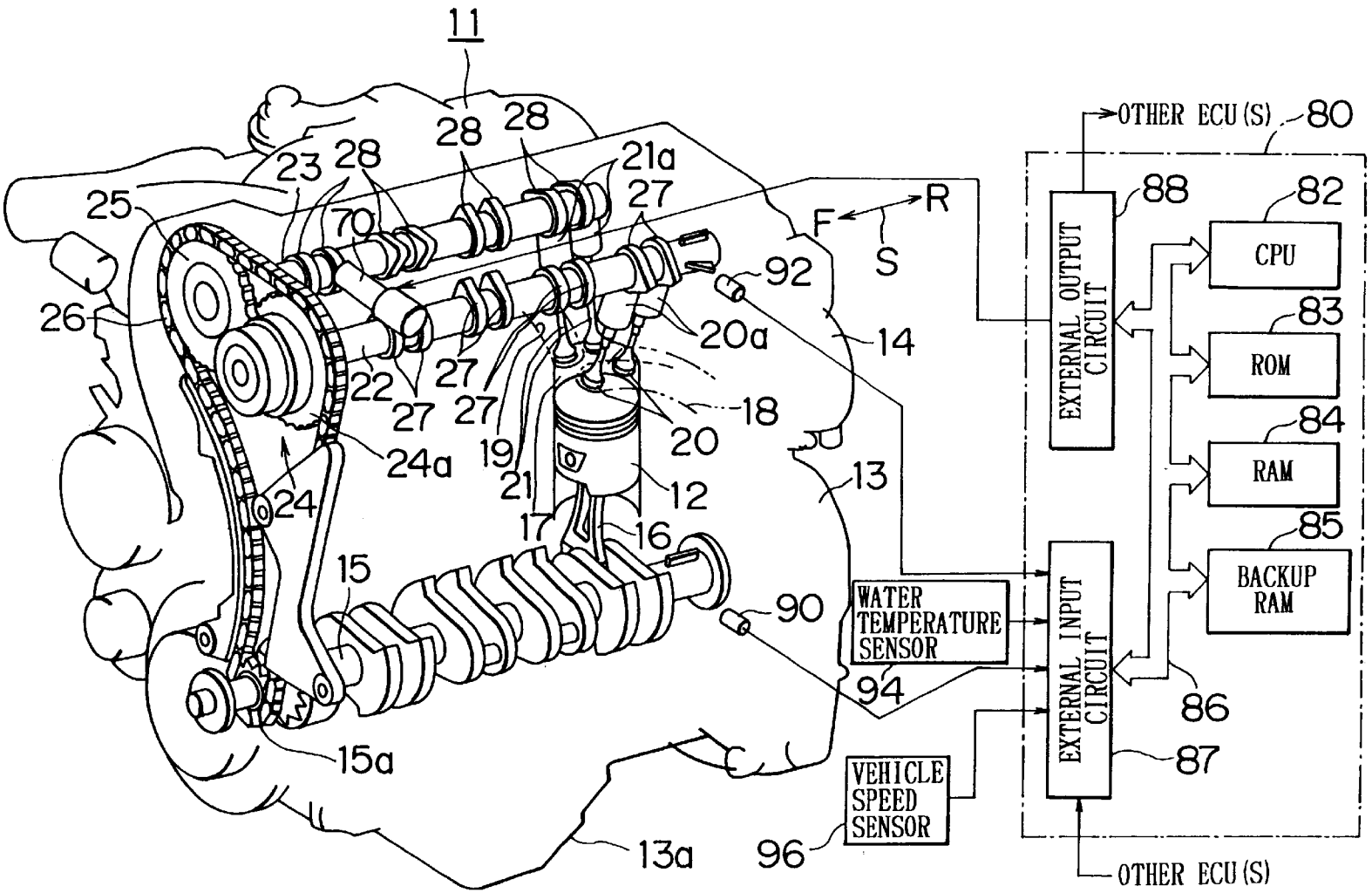
FIG. 1 is a schematic illustration of the construction of an engine and a control system where a variable valve characteristic control apparatus according to a first embodiment of the invention is incorporated.

A first embodiment will be described with reference to FIG. 1, which is a schematic illustration of the construction of an internal combustion engine 11 in which a variable valve characteristic control apparatus according to the invention is incorporated. FIG. 1 also shows a block diagram of an electronic control unit (hereinafter, referred to as "ECU") 80 provided as a control system.

The engine 11 is an in-line four-cylinder gasoline engine for a vehicle. The engine 11 has a cylinder block 13 provided with reciprocating pistons 12, an oil pan 13*a* provided below the cylinder block 13, and a cylinder head 14 provided above the cylinder block 13.

A crankshaft 15, that is, an output shaft of the engine 11, is rotatably supported by a lower portion of the engine 11. The crankshaft 15 is connected to the pistons 12 via connecting rods 16. Reciprocating movements of the pistons 12 are converted into rotation of the crankshaft 15 by the connecting rods 16. A combustion chamber 17 is formed above each piston 12. The combustion chambers 17 are connected to an intake passage 18 and an exhaust passage 19. Communication between the intake passage 18 and the combustion chambers 17 is established and blocked by corresponding intake valves 20. Communication between the exhaust passage 19 and the combustion chambers 17 is established and blocked by corresponding exhaust valves 21.

An intake-side camshaft 22 and an exhaust-side camshaft 23 extend in parallel in the cylinder head 14. The intake-side camshaft 22 is supported by the cylinder head 14 so that the intake-side camshaft 22 is rotatable and movable in the directions of an axis thereof. The exhaust-side camshaft 23 is supported by the cylinder head 14 so that the exhaust-side camshaft 23 is rotatable but is prevented from moving in the axial directions.

An end portion of the intake-side camshaft 22 is provided with a variable valve characteristic control device 24 having a timing sprocket 24*a*. An end portion of the exhaust-side camshaft 23 is provided with a timing sprocket 25. The timing sprocket 25 and the timing sprocket 24*a* of the variable valve characteristic control device 24 are connected by a timing chain 26 to a sprocket 15*a* fixed to the crankshaft 15. Rotation of the crankshaft 15, that is, rotation of the output shaft, is transmitted to the timing sprockets 24*a*, 25 by the sprocket 15*a* and the timing chain 26, so that the intake-side camshaft 22 and the exhaust-side camshaft 23 rotate synchronously with rotation of the crankshaft 15.

The variable valve characteristic control device 24 operates on the intake-side camshaft 22 to adjust the position of the intake-side camshaft 22 in the directions of the rotating axis of the intake-side camshaft 22.

The intake-side camshaft 22 is provided with intake cams 27 each of which contacts a corresponding valve lifter 20*a* provided on an upper end of each intake valve 20. The exhaust-side camshaft 23 is provided with exhaust cams 28 each of which contacts a corresponding valve lifter 21 a provided on an upper end of each exhaust valve 21. When the intake-side camshaft 22 and the exhaust-side camshaft 23 rotate synchronously with the crankshaft 15, the intake valves 20 are opened and closed in accordance with the cam profile of the intake cams 27, and the exhaust valves 21 are opened and closed in accordance with the cam profile of the exhaust cams 28.

Figure 2:
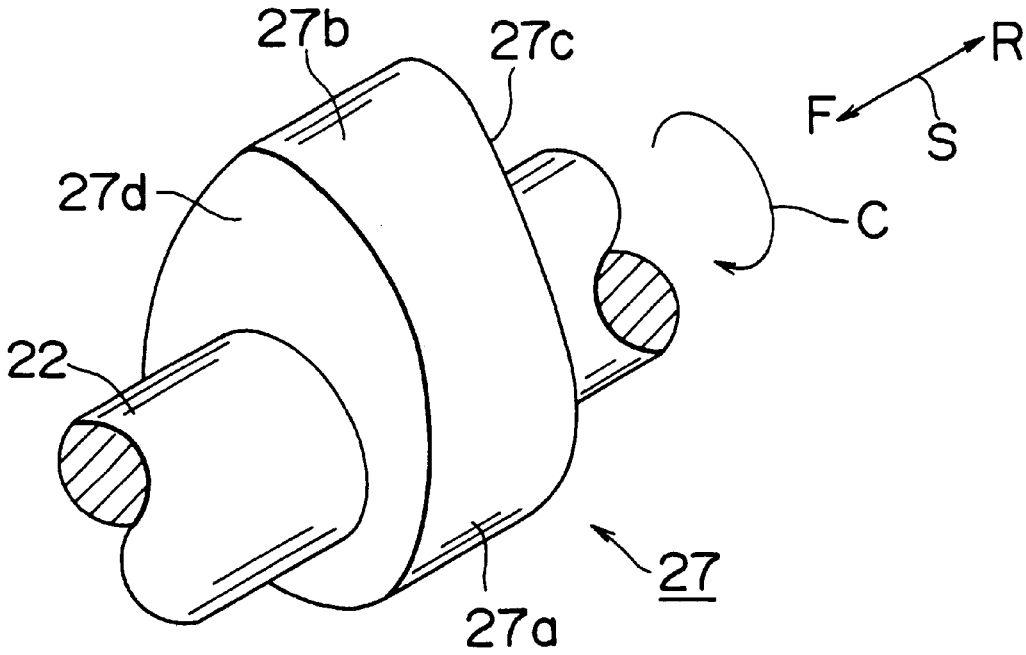
FIG. 2 is a perspective view of an intake cam according to the first embodiment.

The cam profile of each exhaust cam 28 is consistent along the rotating axis of the exhaust-side camshaft 23. On the other hand, the cam profile of each intake cam 27 on a cam surface 27*a*, as shown in FIG. 2, continuously changes along the rotating axis of the intake-side camshaft 22 (indicated by an arrow S). That is, the intake cams 27 are three-dimensional cams. The cam profile of the intake cams 27 will be described in detail below.

Figure 3:
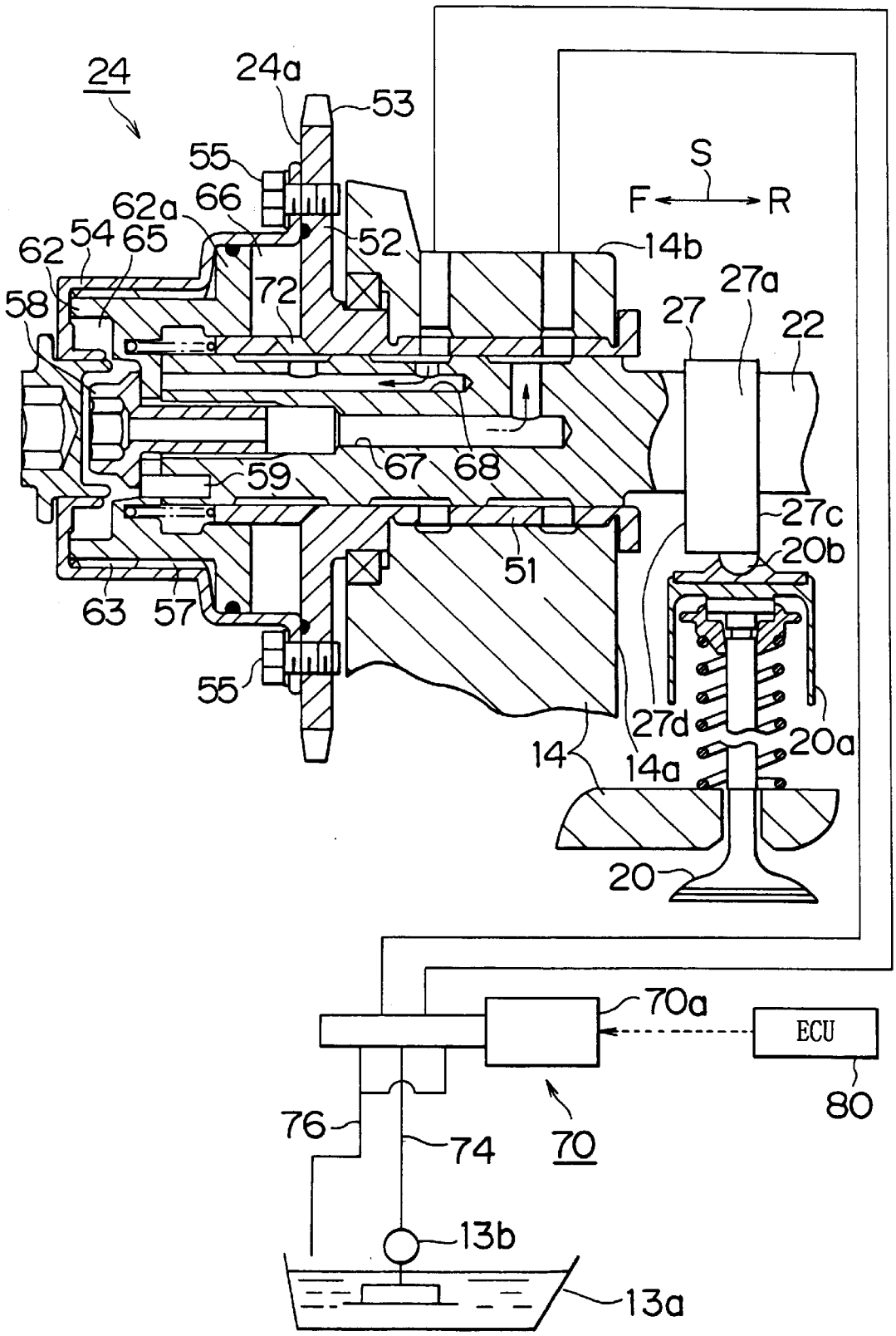
FIG. 3 shows a longitudinal sectional view of the variable valve characteristic control apparatus of the first embodiment and an illustration of a hydraulic system.

The variable valve characteristic control device 24 for adjusting the valve characteristic of the intake cams 27 by shifting the intake-side camshaft 22 along the rotating axis of the intake-side camshaft 22 will next be described in detail with reference to FIG. 3.

The timing sprocket 24*a* of the variable valve characteristic control device 24 is substantially formed by a hollow cylindrical portion 51 through which the intake-side camshaft 22 extends, a disc portion 52 extending from an outer peripheral face of the cylindrical portion 51, and a plurality of external teeth 53 formed in an outer peripheral face of the disc portion 52. The cylindrical portion 51 of the timing sprocket 24*a* is rotatably supported by a journal bearing 14*a* and a camshaft bearing cap 14*b* of the cylinder head 14. The intake-side camshaft 22 extends through the cylindrical portion 51 in such a manner that the intake-side camshaft 22 is movable in the directions F/R along the axis of the intake-side camshaft 22.

A cover 54 is fixed to the timing sprocket 24*a* by bolts 55 so as to cover an end portion of the intake-side camshaft 22. A plurality of internal teeth 57 are arranged in circumferential directions in an inner peripheral face of the cover 54 at a site thereof corresponding to the end portion of the intake-side camshaft 22. Each of the internal teeth 57 linearly extends in the directions of the rotating axis of the intake-side camshaft 22.

A cylindrically shaped ring gear 62 is fixed to the distal end of the intake-side camshaft 22 by a hollow bolt 58 and a pin 59. An outer peripheral face of the ring gear 62 is provided with spur teeth 63 meshed with the internal teeth 57 of the cover 54. Each of the spur teeth 63 linearly extends along the rotating axis of the intake-side camshaft 22. Therefore, the ring gear 62 is movable together with the intake-side camshaft 22 in the directions F/R along the rotating axis of the intake-side camshaft 22.

In the variable valve characteristic control device 24 constructed as described above, when rotation of the crankshaft 15 produced by operation of the engine 11 is transmitted to the timing sprocket 24*a* by the timing chain 26, the intake-side camshaft 22 is rotated via the variable valve characteristic control device 24. As the intake-side camshaft 22 rotates, the intake valves 20 are opened and closed.

When the ring gear 62 is moved toward the timing sprocket 24*a* (in a direction indicated by an arrow R) by a mechanism (described below), the intake-side camshaft 22 is moved in the direction R together with the ring gear 62. As a result, the contact position of a cam follower 20*b* provided on each valve lifter 20*a* is moved on the cam surface 27*a* of the corresponding intake cam 27 from a direction R-side section to a direction F-side section of the cam surface 27*a*. When the ring gear 62 is moved toward the cover 54 (in the direction indicated by an arrow F), the intake-side camshaft 22 is moved together in the direction F, so that the contact position of each cam follower 20*b* shifts from a direction F-side section to a direction R-side section of the cam surface 27*a* of each intake cam 27.

A construction of the variable valve characteristic control device 24 for hydraulically controlling the movement of the ring gear 62 will next be described.

An outer peripheral face of a disc-like ring portion 62*a* of the ring gear 62 is placed in close contact with an inner peripheral face of the cover 54 in such a manner that the ring gear 62 is slidable in the directions F/R along the axis thereof. Therefore, the internal space of the cover 54 is divided into a second lift pattern-side hydraulic chamber 65 and a first lift pattern-side hydraulic chamber 66. The intake-side camshaft 22 has therein a second lift pattern control fluid passage 67 and a first lift pattern control fluid passage 68 connected to the second lift pattern-side hydraulic chamber 65 and the first lift pattern-side hydraulic chamber 66, respectively.

The second lift pattern control fluid passage 67 connects to the second lift pattern-side hydraulic chamber 65 through the hollow bolt 58, and also connects to an oil control valve 70 through an interior of the camshaft bearing cap 14*b* and an interior of the cylinder head 14. The first lift pattern control fluid passage 68 connects to the first lift pattern-side hydraulic chamber 66 through a fluid passage 72 extending through the cylindrical portion 51 of the timing sprocket 24*a*, and also connects to the oil control valve 70 through an interior of the camshaft bearing cap 14*b* and an interior of the cylinder head 14.

A supply passage 74 and a discharge passage 76 are connected in communication to the oil control valve 70. The supply passage 74 is connected to the oil pan 13*a* via an oil pump 13b. The discharge passage 76 is directly connected to the oil pan 13*a*.

The oil control valve 70 has an electromagnetic solenoid 70*a*. When the electromagnetic solenoid 70*a* is demagnetized, operating fluid is supplied from the oil pan 13*a* toward the first lift pattern-side hydraulic chamber 66 of the variable valve characteristic control device 24 via the oil control valve 70 and the first lift pattern control fluid passage 68 (as indicated by an arrow in the first lift pattern control fluid passage 68 in FIG. 3), in accordance with state of communication of ports provided inside the oil control valve 70. Fluid is returned from the second lift pattern-side hydraulic chamber 65 of the variable valve characteristic control device 24 toward the oil pan 13*a* via the second lift pattern control fluid passage 67 (as indicated by an arrow in the second lift pattern control fluid passage 67 in FIG. 3) and then via the oil control valve 70 and the discharge passage 76. As a result, the ring gear 62 is moved within the cover 54 toward the second lift pattern-side hydraulic chamber 65 so as to move the intake-side camshaft 22 in the direction F. Therefore, the contact position of each cam follower 20*b* on the corresponding cam surface 27*a* becomes adjacent to an end face 27*c* of each intake cam 27 facing in the direction R (hereinafter, referred to as a rearward end face).

Conversely, when the electromagnetic solenoid 70*a* is magnetized, operating fluid is supplied from the oil pan 13*a* toward the second lift pattern-side hydraulic chamber 65 of the variable valve characteristic control device 24 via the supply passage 74, the oil control valve 70 and the second lift pattern control fluid passage 67, in accordance with the condition of communication of the ports provided in the oil control valve 70, in a manner opposite to the above-described manner. Furthermore, operating fluid is returned from the first lift pattern-side hydraulic chamber 66 of the variable valve characteristic control device 24 to the oil pan 13*a* via the first lift pattern control fluid passage 68, the oil control valve 70 and the discharge passage 76. As a result, the ring gear 62 is moved toward the first lift pattern-side hydraulic chamber 66, so that the contact position of each cam follower 20*b* on the corresponding cam surface 27*a* shifts toward an end surface 27*d* of each intake cam 27 facing in the direction F (hereinafter, referred to as "forward face").

When electrification of the electromagnetic solenoid 70*a* is controlled to prevent operating fluid from moving between the ports provided in the oil control valve 70, supply of operating fluid to or discharge thereof from the second lift pattern-side hydraulic chamber 65 and the first lift pattern-side hydraulic chamber 66 is prevented. Therefore, operating fluid is held in the second lift pattern-side hydraulic chamber 65 and the first lift pattern-side hydraulic chamber 66, so that the ring gear 62 is fixed in position. As a result, the contact position of each cam follower 20*b* on the corresponding cam surface 27*a* is maintained, that is, the lift pattern of the intake valves 20 remains in the state achieved by the ring gear 62 fixed in position as described above.

An electronic control unit (ECU) 80 that controls the oil control valve 70 as described above is formed as a logical operation circuit having a CPU 82, a ROM 83, a RAM 84, a backup RAM 85, and the like, as shown in FIG. 1.

The ROM 83 is a memory storing various control programs, maps that are referred to when such control programs are executed, and the like. The CPU 82 executes necessary operations based on the various control programs stored in the ROM 83. The RAM 84 is a memory for temporarily storing results of the operations of the CPU 82, data inputted from various sensors, and the like. The backup RAM 85 is a non-volatile memory for storing data that needs to be retained even after the engine 11 is stopped. The CPU 82, the ROM 83, the RAM 84 and the backup RAM 85 are interconnected by a bus 86, and are connected to an external input circuit 87 and an external output circuit 88.

The external input circuit 87 is connected to a crank-side electromagnetic pickup 90 for detecting engine revolution speed, an intake cam-side electromagnetic pickup 92 for detecting the cam angle of the intake cams 27 and the amount of movement of the intake-side camshaft 22 in the directions of the rotating axis thereof, a water temperature sensor 94 for detecting the temperature of cooling water of the engine 11, a vehicle speed sensor 96, and the like. The external output circuit 88 is connected to the oil control valve 70.

This embodiment performs the valve characteristic control of the intake valves 20 by using the ECU 80 constructed as described above. That is, the ECU 80 detects operational conditions of the engine 11 based on detection signals from the various sensors. In order to achieve an appropriate operational condition of the engine 11 in accordance with the result of detection, the ECU 80 controls and drives the oil control valve 70 to adjust the lift pattern of the intake valves 20. For the lift pattern adjustment, the ECU 80 determines the position of the intake-side camshaft 22 in a direction of the rotating axis of the intake-side camshaft 22. Then, the ECU 80 executes feedback control of the variable valve characteristic control device 24 by using the oil control valve 70 so as to realize a target lift pattern of the intake valves 20.

The cam lift pattern determined by the cam profile defined by the cam surface 27*a* of each intake cam 27 as shown in FIG. 2 will be described.

In each intake cam 27, a nose 27*b* has a height that is consistent along the rotating axis of the intake cam 27. A cam profile at a rearward end face 27*c* is substantially symmetric about a line of the height of the nose 27*b*, that is, a valve opening-side portion and a valve closing-side portion of the cam profile are substantially symmetric.

Figure 4:
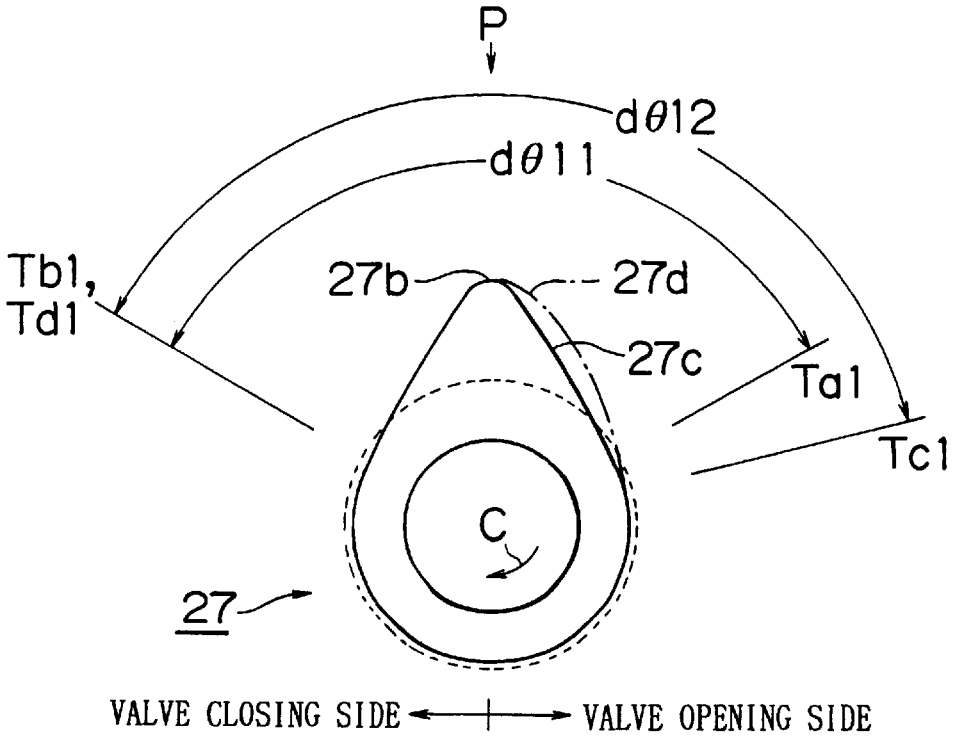
FIG. 4 is an illustration of cam profiles of the intake cam of the first embodiment.
Figure 5:
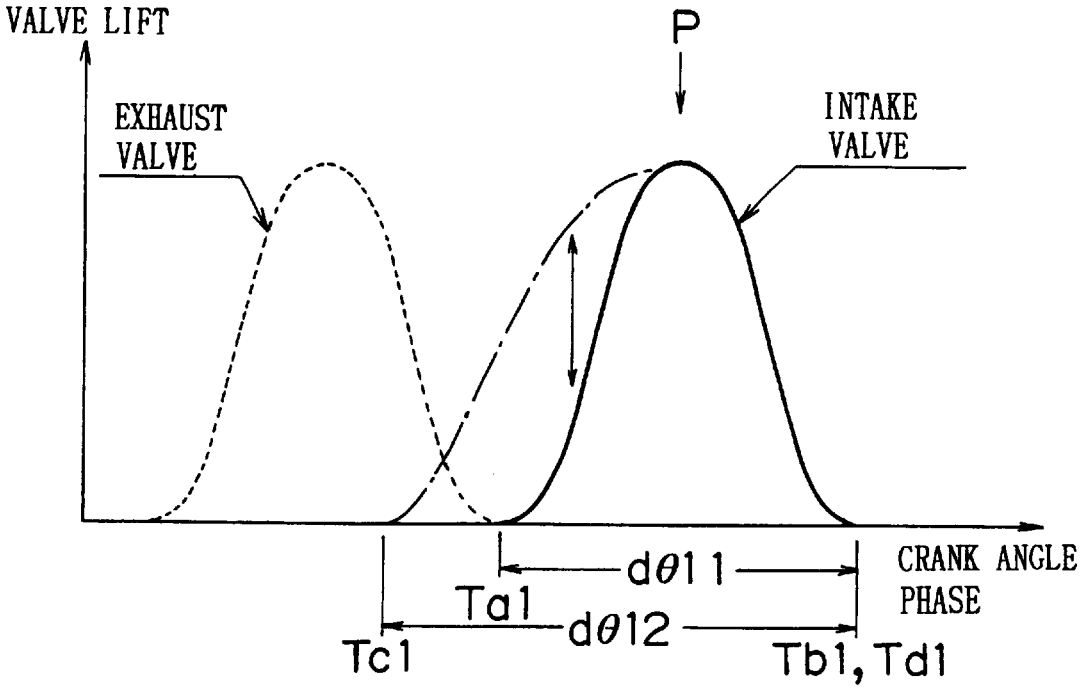
FIG. 5 is a graph indicating lift patterns achieved by the intake cam of the first embodiment.

In contrast, a cam profile at a forward end face 27*d* is not symmetric. The valve closing-side portion of the cam profile at the forward end face 27*d* is substantially the same as the valve closing-side portion of the cam profile at the rearward end face 27*c*, whereas the valve opening-side portion of the cam profile at the forward end face 27*d* forms a higher lift pattern (indicated by a one-dot chain line in FIG. 4) than the valve opening-side portion of the cam profile at the rearward end face 27*c*. In FIG. 4, a circle of a simple broken line indicates the cam height of zero lift (The zero-lift cam height will be indicated also by a broken line circuit in the illustrations of other embodiments.). Therefore, as indicated in FIG. 5, the intake valves 20 can provide a first lift pattern determined by the rearward end face 27*c*-side cam profile (indicated by a solid line) and a second lift pattern determined by the forward end face 27*d*-side cam profile (indicated by a one-dot chain line).

In an advance side (left side of P) of a crank angle phase (hereinafter, referred to simply as "phase") of peak P, that is, a maximum lift, the second lift pattern is higher than the first lift pattern, thereby providing a difference in amount of lift.

The opening timing Tc1 of each intake valve 20 determined by the second lift pattern is earlier than the opening timing Ta1 of the intake valve 20 determined by the first lift pattern. However, the closing timing Td1 of the intake valve 20 determined by the second lift pattern is the same as the closing timing Tb1 thereof determined by the first lift pattern. Therefore, the valve operation angle dθ12 of the second lift pattern is greater than the valve operation angle dθ11 of the first lift pattern.

Thus, each intake cam 27 has, on the sides of the end faces 27*c*, 27*d* along the rotating axis, two cam profiles determining the two different lift patterns as described above. In an intermediate portion between the two end faces, the cam profile continuously varies from one of the two cam profiles to the other cam profile. Therefore, the lift pattern of the intake valves 20 can be varied continuously between the first lift pattern indicated by the solid line in FIG. 5 and the second lift pattern indicated by the one-dot chain line in FIG. 5 through the control of the oil control valve 70.

In the above-described lift pattern changing control, the opening timing of the intake valves 20 is changed while the closing timing thereof is maintained. Although the valve opening timing is changed, the amount of lift of each intake valve 20 at the peak position P and the amount of lift in the delay side of the peak position P remain unchanged.

The first embodiment realizes the two lift patterns and continuously various lift patterns therebetween for the intake valves 20 by driving the variable valve characteristic control device 24. The two lift patterns have a phase in which the amount of lift differs therebetween and a phase in which the amount of lift does not differ, within the valve operation angle. More specifically, within the valve operation angle, the amount of lift differs between the two lift patterns in the advance side of the peak P, but does not differ therebetween in the delay side of the peak P.

Since the intake cams 27 have the above-described two lift patterns, a phase in which the amount of lift does not differ between the two lift patterns and differences in the amount of lift therebetween in the other phases can be set in accordance with the characteristics of the engine 11. Through such conformation to the characteristics of the engine 11, it becomes possible to constantly realize a valve characteristic in accordance with the operational condition of the engine 11. Therefore, further improvements can be achieved in the output performance, fuel consumption, combustion stability and the like of the engine 11.

In particular, since the amount of lift at the peak P and the closing timing of each intake valve 20 remain unchanged, a suitable compression rate or a suitable volume efficiency is maintained with the proper closing timing and the amount of lift at the peak P while the valve opening timing is advanced or delayed. Therefore, the invention according to the first embodiment makes it possible to realize a combustion stability during idling, a reduction of the pump loss, sufficient internal EGR due to the valve overlap in accordance with the operational condition of the engine 11, and the like.

Although in the first embodiment, each intake cam 27 provides variable amounts of lift only in the advance side of the phase of the peak of the amount of lift, it is also possible to adopt intake cams each of which provides variable amounts of lift only in the delay side of the phase of the peak of the amount of lift, that is, it is possible to adopt intake cams that allow the closing timing to be advanced or delayed without changing the valve opening timing nor changing the amount of lift of the intake valves. This construction makes it possible to advance and delay the closing timing of the intake valves while maintaining a combustion stability, a pump loss, or a suitable internal EGR in accordance with the operational condition of the engine based on the proper opening timing and the main peak amount of lift of the intake valves. As a result, the compression ratio and the volume efficiency can be properly adjusted in accordance with the operational condition.

Figure 6:
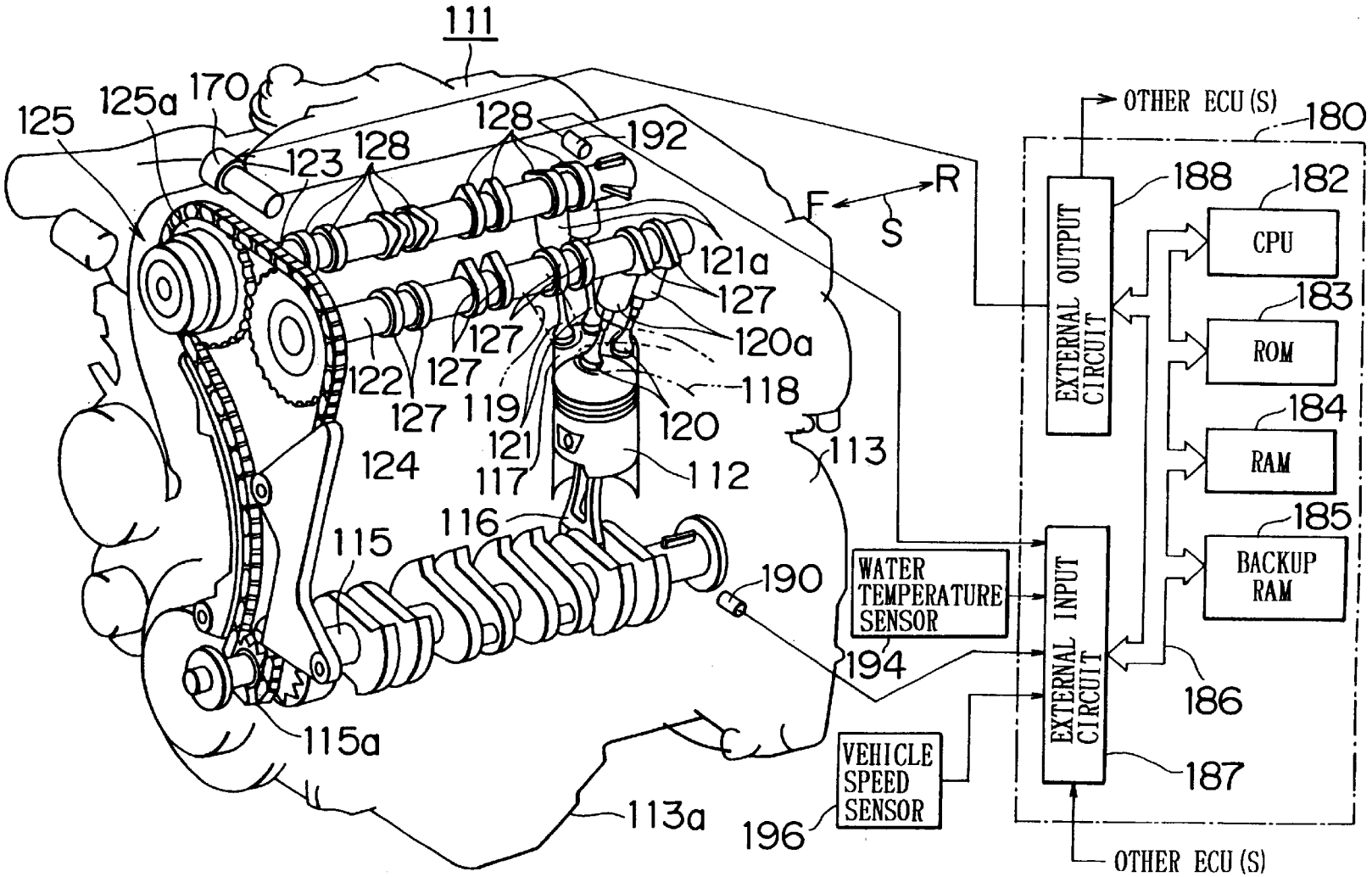
FIG. 6 is a schematic illustration of the construction of an engine and a control system in which a variable valve characteristic control apparatus according to a second embodiment of the invention is incorporated.

A second embodiment of the invention will be described with reference to FIG. 6, which is a schematic illustration of an engine 111. The second embodiment differs from the first embodiment in that a variable valve characteristic control device 125 is not provided on a timing sprocket 124 of an intake-side camshaft 122, but it is provided integrally with a timing sprocket 125*a* on a side of an exhaust-side camshaft 123.

Therefore, the intake-side camshaft 122 is prevented from moving along a rotating axis of the intake-side camshaft 122, whereas the exhaust-side camshaft 123 is allowed to move along a rotating axis thereof. Intake cams 127 have a cam profile that is consistent along the rotating axis. On the other hand, exhaust cams 128 are formed as three-dimensional cams whose cam profile changes along the rotating axis thereof. Hence, an ECU 180 controls the variable valve characteristic control device 125 in a manner corresponding to the profile of the exhaust cams 128.

Many of the features of the second embodiment are basically the same as those of the first embodiment. Accordingly, portions and components of the second embodiment comparable in function to those of the first embodiment are represented by reference numerals obtained by adding "100" to the reference numerals of the portions and components of the first embodiment in the drawings. These features will not be describe again.

Figure 7:
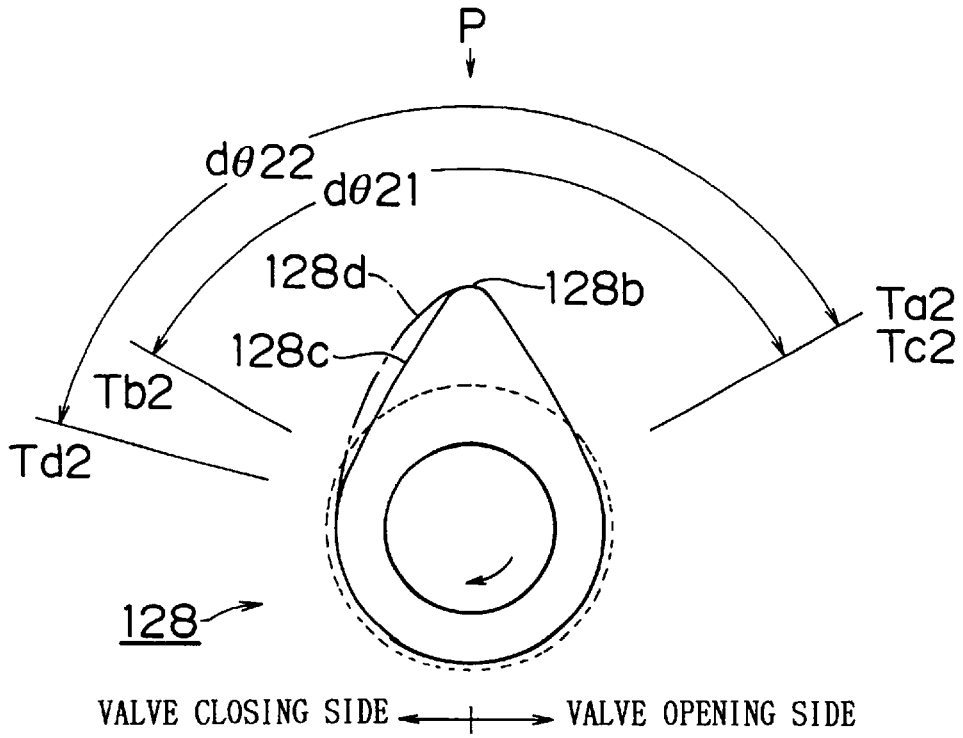
FIG. 7 is an illustration of cam profiles of an exhaust cam according to the second embodiment.

FIG. 7 indicates the configuration (profiles) of each exhaust cam 128 in the second embodiment.

Figure 8:
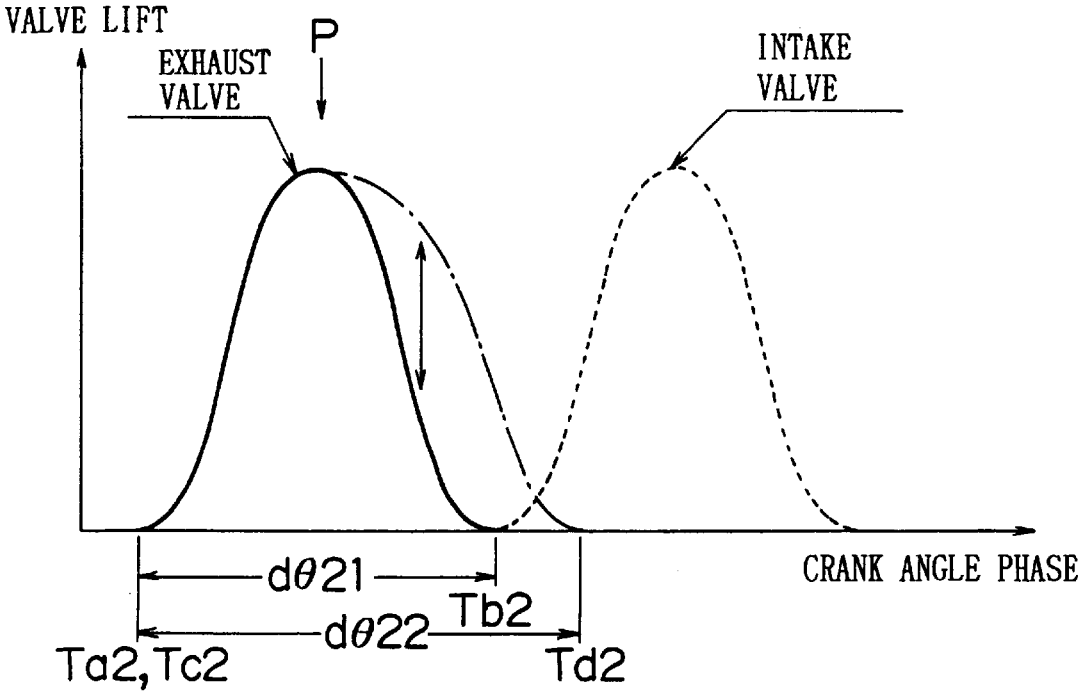
FIG. 8 is a graph indicating lift patterns achieved by the exhaust cam of the second embodiment.

In the exhaust cams 128, the height of a nose 128*b* is consistent along the rotating axis of the exhaust cams 128. As indicated by a solid line in FIG. 7, a cam profile at a rearward end face 128*c* is substantially symmetric about a line of the height of the nose 128*b*. That is, a valve opening-side portion and a valve closing-side portion of the cam profile are substantially symmetric (solid line). In contrast, a valve opening-side portion and a valve closing-side portion of a cam profile at a forward end face 128*d* along the rotating axis are not symmetric to each other. More specifically, the valve opening-side portion of the cam profile at the forward end face 128*d* is substantially the same as the valve opening-side portion of the cam profile at the rearward end face 128*c*, whereas the valve closing-side portion of the cam profile at the forward end face 128*d* forms a higher lift pattern (indicated by a one-dot chain line in FIG. 7) than the valve closing-side portion of the cam profile at the rearward end face 128*c*. Therefore, as indicated in FIG. 8, the exhaust cams 128 can provide a first lift pattern determined by the rearward end face 128*c*-side cam profile (indicated by a solid line) and a second lift pattern determined by the forward end face 128*d*-side cam profile (indicated by a one-dot chain line).

In the delay side of the phase of a peak P, that is, a maximum amount of lift, the second lift pattern is higher than the first lift pattern, thereby providing a difference in amount of lift.

The closing timing Td2 of each exhaust valve 121 determined by the second lift pattern is later than the closing timing Tb2 of the exhaust valve 121 determined by the first lift pattern. However, the opening timing Tc2 of each exhaust valve 121 determined by the second lift pattern is the same as the opening timing Ta2 thereof determined by the first lift pattern. Therefore, the valve operation angle dθ22 of the second lift pattern is greater than the valve operation angle dθ21 of the first lift pattern.

Thus, each exhaust cam 128 has, on the sides of the end faces 128*c*, 128*d* in the directions F/R along the rotating axis, two cam profiles determining the two different lift patterns as described above. In an intermediate portion between the two end faces, the cam profile continuously varies from one of the two cam profiles to the other cam profile. Therefore, the lift pattern of the exhaust valves 121 can be varied continuously between the first lift pattern indicated by the solid line in FIG. 8 and the second lift pattern indicated by the one-dot chain line in FIG. 8 through the control of an oil control valve 170.

In the above-described lift pattern changing control, the closing timing of the exhaust valves 121 is changed while the opening timing thereof is maintained. Although the valve closing timing is changed, the amount of lift of each exhaust valve 121 at the peak position P and the amount of lift in the advance side of the peak position P remain unchanged.

Therefore, the invention according to the second embodiment is able to delay or advance the closing timing of the exhaust valves 121 without changing the amount of lift at the peak P or changing the opening timing of the exhaust valves 121. As a result, it becomes possible to delay or advance the closing timing of the exhaust valves 121 while maintaining a low noise level and a high volume efficiency due to suitable blow-down with a proper opening timing and a proper amount of lift at the peak P. Therefore, it is possible to realize a combustion stability during idling, a reduction of the pump loss, sufficient internal EGR due to the valve overlap in accordance with the operational condition of the engine 111, and the like.

Although in the second embodiment each exhaust cam 128 provides variable amounts of lift only in the delay side of the phase of the peak of the amount of lift, it is also possible to adopt exhaust cams in which each provides variable amounts of lift only in the advance side of the phase of the peak of the amount of lift. That is, it is possible to adopt exhaust cams that allow the opening timing to be advanced or delayed without changing the valve closing timing or the amount of lift of the exhaust valves. This makes it possible to advance and delay the opening timing of the exhaust valves while maintaining a combustion stability, a pump loss, or a suitable internal EGR in accordance with the operational condition of the engine based on the proper closing timing and the peak amount of lift of the exhaust valves. As a result, the blow-down can be varied, so that the catalyst activity can be quickly increased during an engine warm-up operation.

Figure 9:
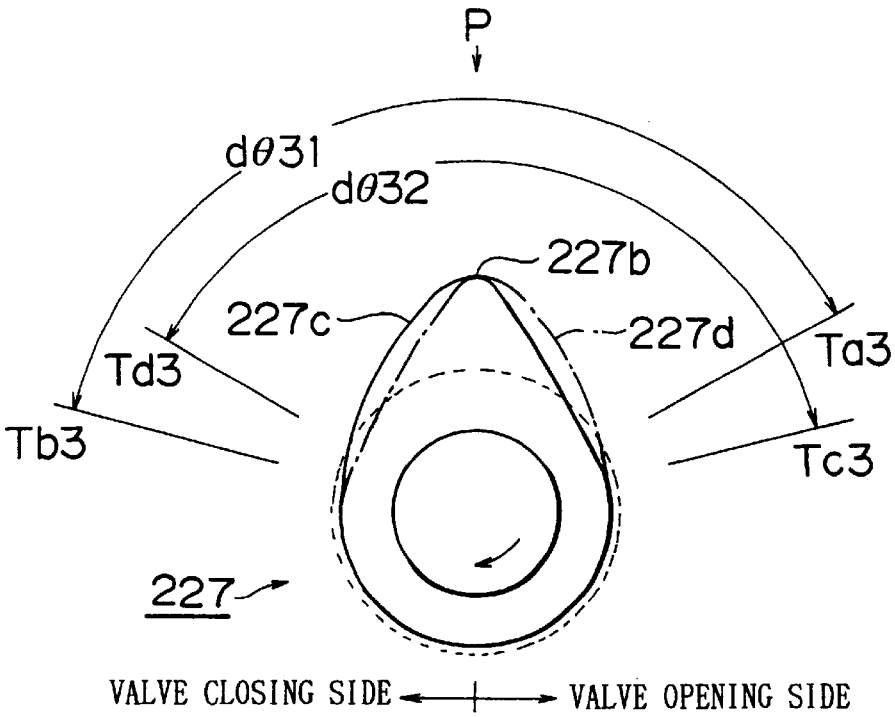
FIG. 9 is an illustration of cam profiles of an intake cam according to a third embodiment of the invention.

A third embodiment of the invention will be described with reference to FIG. 9 and differs from the first embodiment only in the cam configuration (profiles) of intake cams 227.

In the intake cam 227, the height of a nose 227*b* is consistent along a rotating axis of the intake cam 227. A cam profile at a rearward end face 227*c* is not symmetric. More specifically, a valve closing-side portion of the cam profile at the rearward end face 227*c* has a higher lift pattern than the valve opening-side portion of the cam profile at the rearward end face 227*c* (indicated by a solid line in FIG. 9). A cam profile at a forward end face 227*d* is not symmetric either. More specifically, a valve opening-side portion of the cam profile at the forward end face 227*d* has a higher lift pattern than a valve closing-side portion of the cam profile at the forward end face 227*d* (indicated by a one-dot chain line in FIG. 9).

The cam profiles at the forward end face 227*d* and the rearward end face 227*c* will be compared. The valve opening-side portion of the forward end face 227*d*-side cam profile (indicated by the one-dot chain line) has a higher lift pattern than the valve-opening side portion of the rearward end face 227*c*-side cam profile (indicated by the solid line). The valve closing-side portion of the forward end face 227*d*-side cam profile (indicated by the one-dot chain line) has a lower lift pattern than the valve-closing side portion of the rearward end face 227*c*-side cam profile (indicated by the solid line).

Therefore, the intake valve opening timing Tc3 determined by the forward end face 227*d*-side cam profile is earlier than the intake valve opening timing Ta3 determined by the rearward end face 227*c*-side cam profile. The intake valve closing timing Td3 determined by the forward end face 227*d*-side cam profile is earlier than the intake valve closing timing Tb3 determined by the rearward end face 227*c*-side cam profile.

Figure 10:
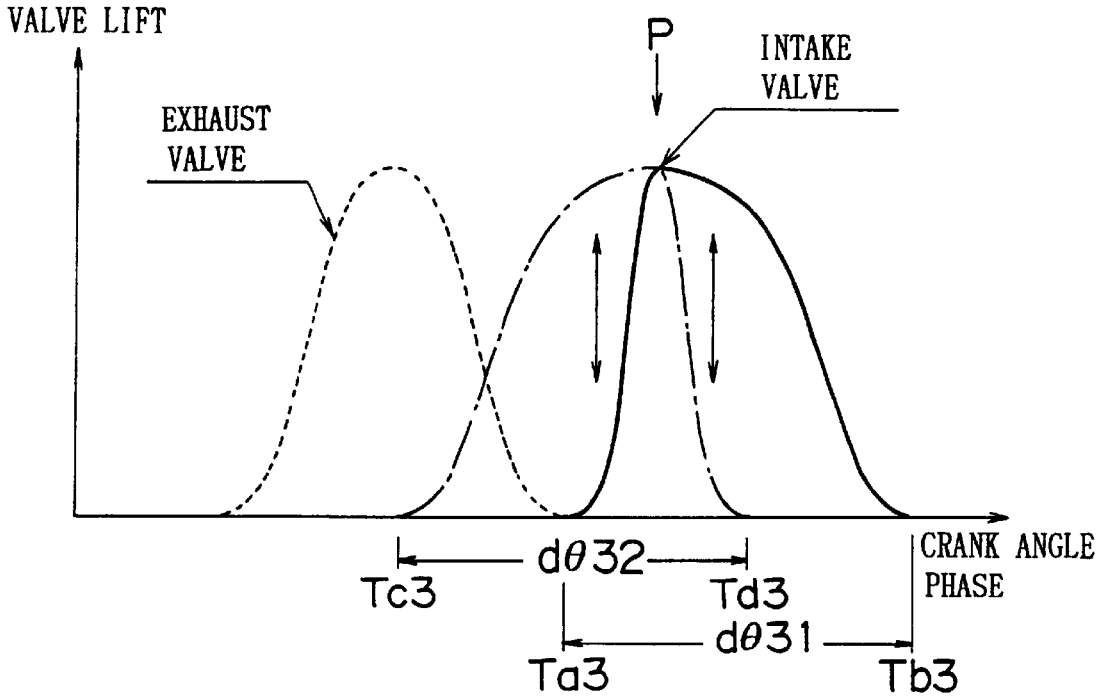
FIG. 10 is a graph indicating lift patterns achieved by the intake cam of the third embodiment.

FIG. 10 is a graph indicating the lift pattern achieved by each intake cam 227. The phase of the lift peak P and the amount of lift at the peak P do not differ between the rearward end face 227*c*-side lift pattern and the forward end face 227*d*-side lift pattern. In the advance side of the phase of the peak P, the forward end face 227*d*-side lift pattern (indicated by a one-dot chain line) is higher than the rearward end face 227*c*-side lift pattern (indicated by a solid line), thereby providing a difference in amount of lift. Furthermore, in the delay side of the phase of the peak P, the rearward end face 227*c*-side lift pattern (solid line) is higher than the forward end face 227*d*-side lift pattern (one-dot chain line), thereby providing a difference in amount of lift.

The valve operation angle dθ31 of the rearward end face 227*c*-side lift pattern is equal to the valve operation angle of the forward end face 227*d*-side lift pattern.

Thus, each intake cam 227 has, on the sides of the end faces 227*c*, 227*d* along the rotating axis, two cam profiles determining the two different lift patterns as described above. In an intermediate portion between the two end faces, the cam profile continuously varies from one of the two cam profiles to the other cam profile. Therefore, the lift pattern of the intake valves can be varied continuously between the first lift pattern indicated by a solid line in FIG. 10 and the second lift pattern indicated by a one-dot chain line in FIG. 10 through the control of an oil control valve.

In the above-described lift pattern changing control, the opening timing and the closing timing of the intake cams 227 are changed in the same directions while the intake valve operation angle timing is maintained in width or extension. Although the valve opening and closing timings are changed, the position of the lift peak P and the amount of lift at the peak position P of each intake cam 227 remain unchanged.

Therefore, the invention according to the third embodiment is able to delay or advance the opening timing and the closing timing of the intake cams 227 while maintaining a suitable compression rate and a suitable volume efficiency with a proper valve operation angle width and a proper amount of lift at the peak P. Therefore, it is possible to realize a combustion stability during idling, a reduction of the pump loss, sufficient internal EGR due to the valve overlap in accordance with the operational condition of the engine, and the like.

The above-described cam configuration (profiles) may also be applied to exhaust cams.

Figure 11:
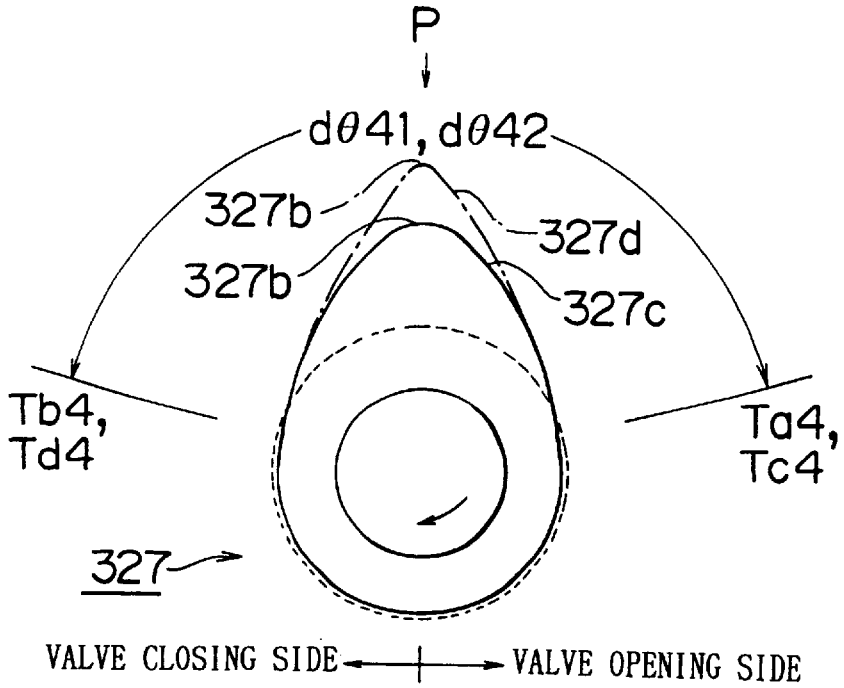
FIG. 11 is an illustration of cam profiles of an intake cam according to a fourth embodiment of the invention.

A fourth embodiment of the invention will be described with reference to FIG. 11, which differs from the first embodiment only in the cam configuration (profiles) of intake cams 327.

In the intake cam 327, the height of a nose 327*b* varies along the rotating axis of the intake cam 327. That is, the height of the nose 327*b* at a forward end face 327*d* (indicated by a one-dot chain line) is greater than the height of the nose 327*b* at a rearward end face 327*c* (indicated by a solid line). In any lift pattern, the valve opening timing Ta4, Tc4 and the valve closing timing Tb4, Td4 remain unchanged. Since the valve and opening timings remain unchanged, the valve operation angle dθ41, dθ42 and its phase remain unchanged if the lift pattern changes.

Figure 12:
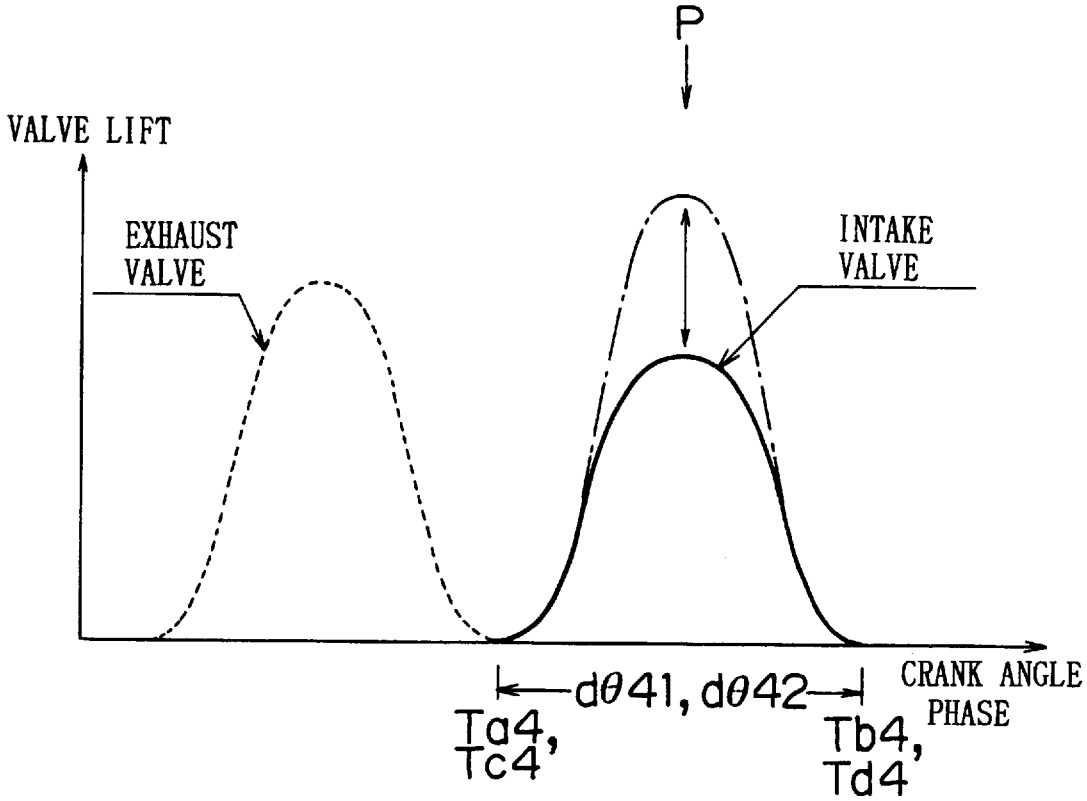
FIG. 12 is a graph indicating lift patterns achieved by the intake cam of the fourth embodiment.

Thus, each intake cam 327 has, on the sides of the end faces 327*c*, 327*d* along the rotating axis, two cam profiles determining the two different lift patterns as described above. In an intermediate portion between the two end faces, the cam profile continuously varies from one of the two cam profiles to the other cam profile. Therefore, the lift pattern of the intake valves can be varied continuously between the first lift pattern indicated by a solid line in FIG. 12 and the second lift pattern indicated by a one-dot chain line in FIG. 12 through the control of an oil control valve.

The thus-realized two lift patterns of the intake valves provide different amounts of lift only in a phase around a peak P, and provide equal amounts of lift in the other phases. Therefore, in this lift pattern changing control, it is possible to change only the valve lift in the phase around the peak P while maintaining the width and the phase of the intake valve operation angle. Furthermore, the position of the lift peak P remains unchanged if the amount of lift is changed. Therefore, it becomes possible to adjust the cam friction or the volume efficiency to appropriate values in accordance with the operational condition of the engine without changing the opening and closing timings of the intake valves.

Although in the fourth embodiment, the above-described cam configuration (profiles) is applied to the intake valves, a similar cam configuration (profiles) may also be applied to exhaust cams, so that it becomes possible to adjust the cam friction or the volume efficiency to appropriate values in accordance with the operational condition of the engine without changing the opening and closing timings of the exhaust valves.

Figure 13:
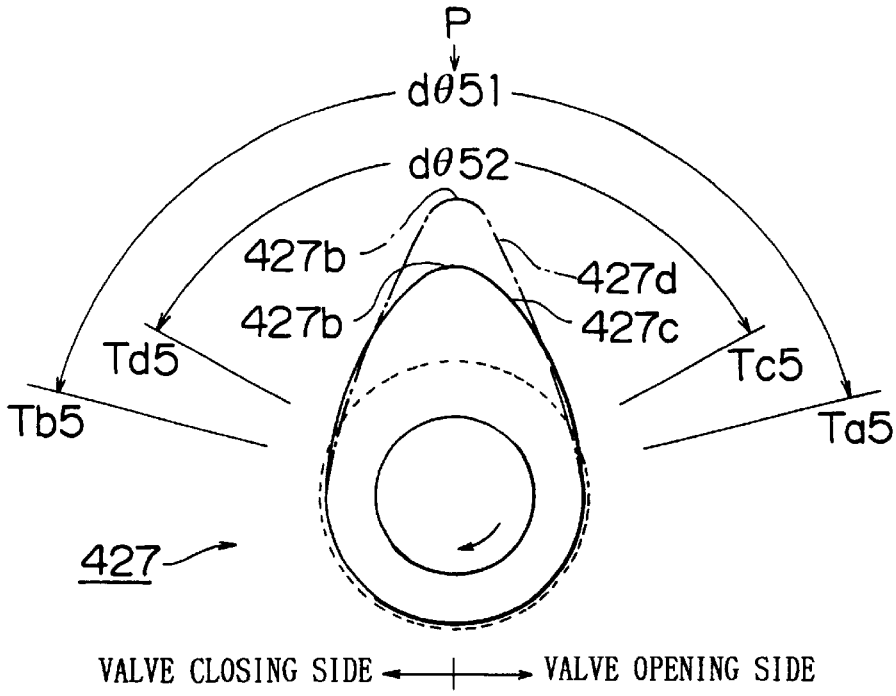
FIG. 13 is an illustration of cam profiles of an intake cam according to a fifth embodiment of the invention.

A fifth embodiment of the invention will be described with reference to FIG. 13, which differs from the first embodiment only in the cam configuration (profiles) of intake cams 427.

In the intake cam 427, the height of a nose 427*b* varies along the rotating axis of the intake cam 427. That is, the height of the nose 427*b* at a forward end face 427*d* (indicated by a one-dot chain line) is greater than the height of the nose 427*b* at a rearward end face 427*c* (indicated by a solid line). The lift patterns determined by the two end face-side cam profiles further differ from each other as follows. The opening timing Ta5 determined by the rearward end face 427*c*-side cam profile is advanced from the opening timing Tc5 determined by the forward end face 427*d*-side cam profile. The closing timing Tb5 determined by the rearward end face 427*c*-side cam profile is delayed from the closing timing Td5 determined by the forward end face 427*d*-side cam profile.

Figure 14:
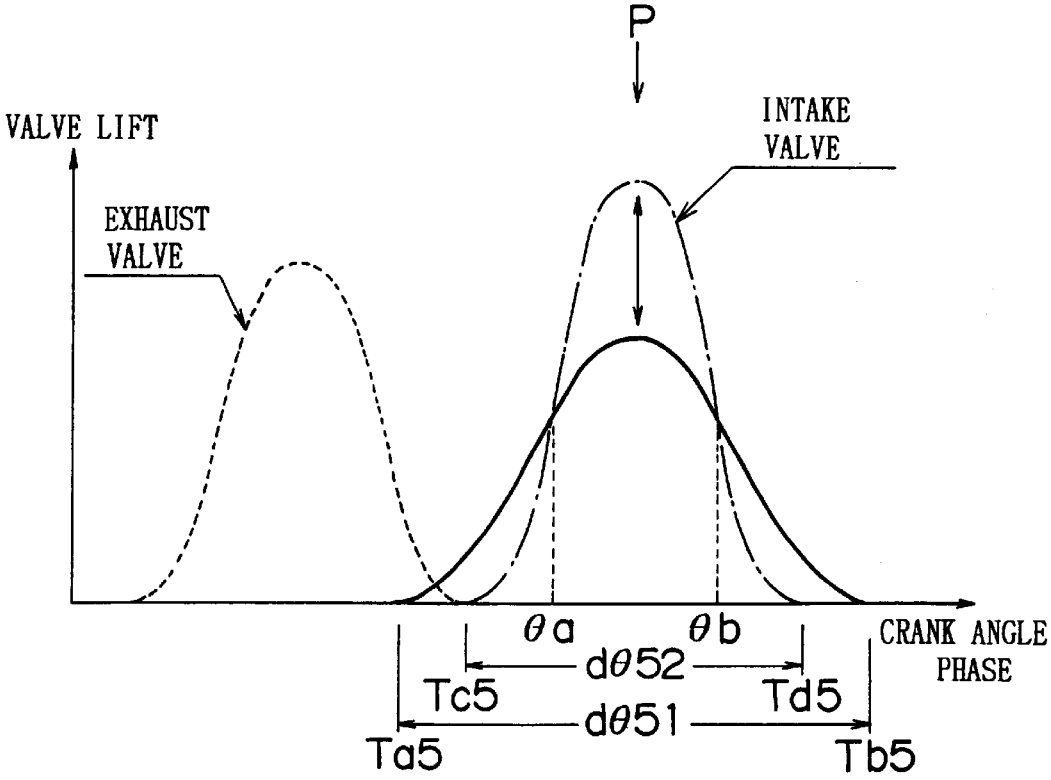
FIG. 14 is a graph indicating lift patterns achieved by the intake cam of the fifth embodiment.

That is, the two lift patterns provide different amounts of lift in a phase in the vicinity of a peak P as indicated in FIG. 14. At phases θa, θb, the amounts of lift in the two lift patterns become equal. Beyond the phases θa, θb, that is, in the advance side of the phase θa and the delay side of the phase θb, the lift magnitude relationship between the two lift patterns is opposite to the lift magnitude relationship therebetween occurring in the phase in the vicinity of the peak P. Thus, the valve operation angle dθ51 determined by the rearward end face 427*c*-side lift pattern (indicated by a solid line) is wider than the valve operation angle dθ52 determined by the forward end face 427*d*-side lift pattern (indicated by a one-dot chain line).

Thus, each intake cam 427 has, on the sides of the end faces 427*c*, 427*d* along the rotating axis, two cam profiles determining the two different lift patterns as described above. In an intermediate portion between the two end faces, the cam profile continuously varies from one of the two cam profiles to the other cam profile. Therefore, the lift pattern of the intake valves can be varied continuously between the first lift pattern indicated by the solid line in FIG. 14 and the second lift pattern indicated by the one-dot chain line in FIG. 14 through the control of an oil control valve.

In the above-described construction, an advance of the opening timing of the intake valves and a delay of the closing timing thereof are simultaneously accomplished by shifting the intake cams 427 so as to shift the cam follower contact position toward the rearward end face 427*c* of each intake cam 427 in accordance with the operational condition of the engine. As a result, the operation angle of the intake valves is expanded, so that the pumping loss of the engine can be reduced. Furthermore, the lift of the intake valves is reduced simultaneously with expansion of the valve operation angle, so that the friction of the intake cams 427 decreases. Therefore, the fuel consumption improves.

Conversely, a delay of the opening timing of the intake valves and an advance of the closing timing thereof are simultaneously accomplished by shifting the intake cams 427 so as to shift the contact position of each cam follower 20*b* toward the forward end face 427*d* of each intake cam 427. As a result, the operation angle of the intake valves is reduced simultaneously with an increase in the valve lift. By opening the intake valves to a great degree of opening in a suitable but narrow target phase range in the aforementioned manner, a high engine output can be produced.

Figure 15:
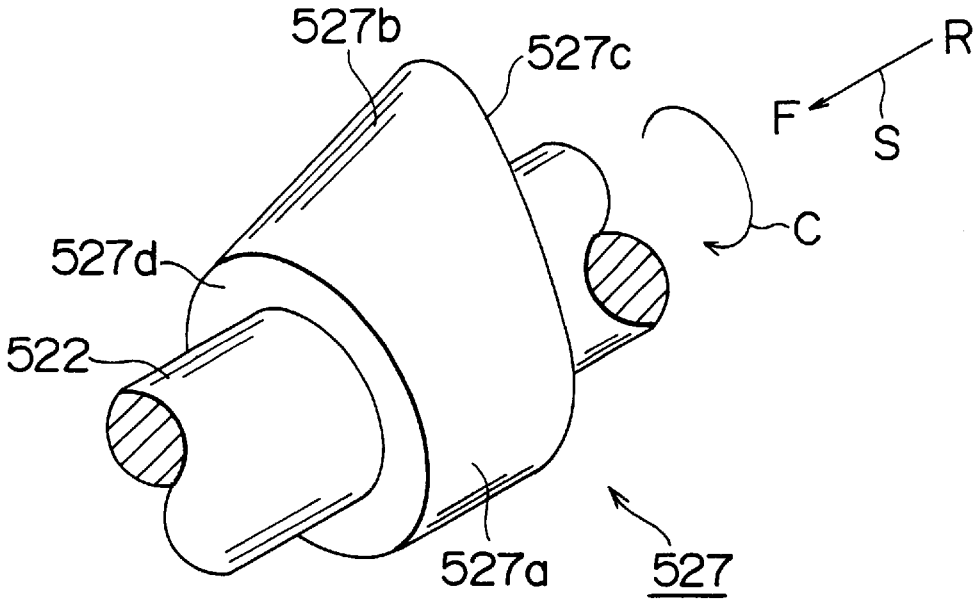
FIG. 15 is a perspective view of an intake cam according to a sixth embodiment of the invention.

A sixth embodiment of the invention will be described with reference to FIG. 15, which differs from the first embodiment only in the cam configuration (profiles) of intake cams 527.

Figure 16:
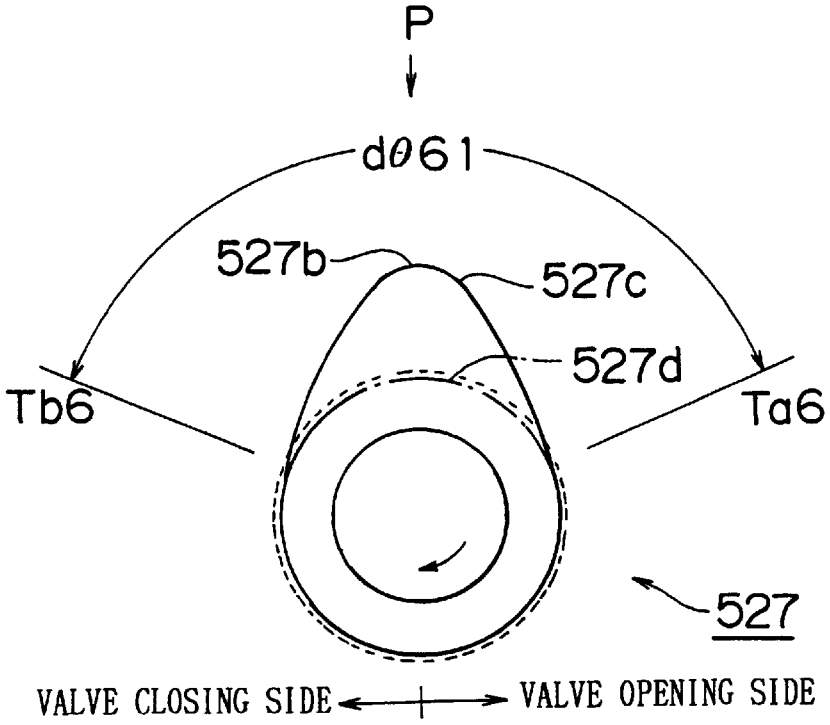
FIG. 16 is an illustration of cam profiles of the intake cam of the sixth embodiment.

In the intake cam 527, a cam profile at a forward end face 527*d* indicated by a one-dot chain line in FIG. 16 has lifts of zero or less over the entire periphery, that is, no valve lift is provided. Therefore, substantially no nose 527*b* exists at the forward end face 527*d*. A cam profile at a rearward end face 527*c* indicated by a solid line provides valve lifts and a valve operation angle dθ61, and defines a nose 527*b*. Therefore, the height of the nose 527*b* increases from zero as the distance to the rearward end face 527*c* (solid line) decreases.

Figure 17:
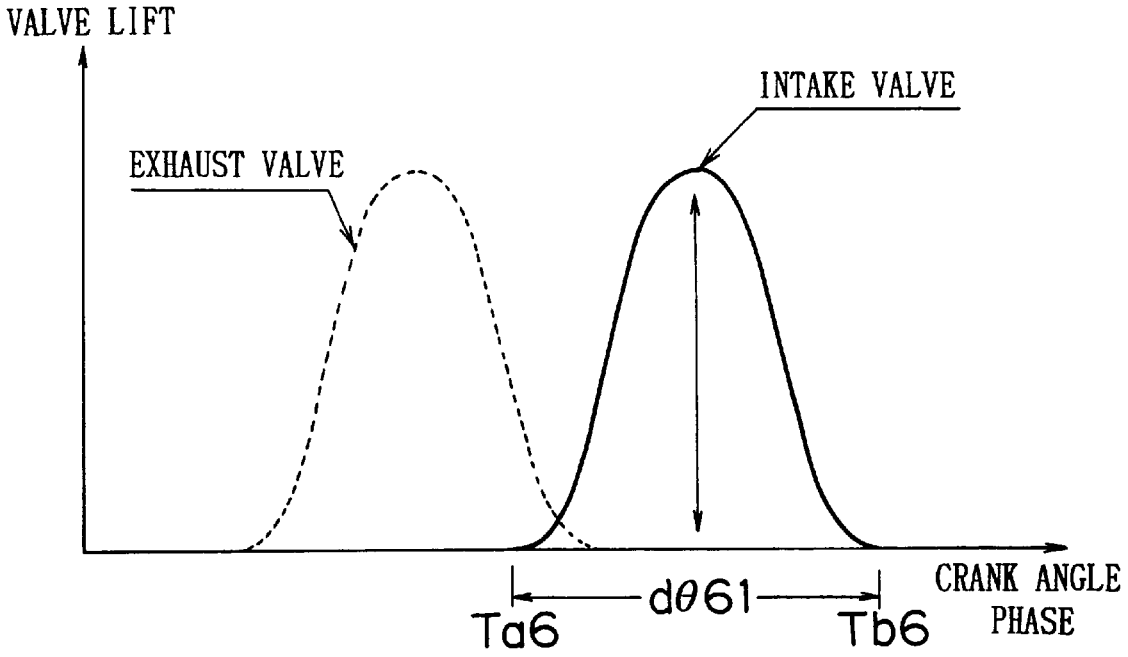
FIG. 17 is a graph indicating lift patterns achieve by the intake cam of the sixth embodiment.

Thus, each intake cam 527 has, on the sides of the end faces 527*c*, 527*d* along the rotating axis, the two cam profiles determining the two different lift patterns as described above. In an intermediate portion between the two end faces, the cam profile continuously varies from one of the two cam profiles to the other cam profile. Therefore, the lift pattern of the intake valves can be varied continuously between the first lift pattern indicated by a solid line in FIG. 17 and the second lift pattern providing no lift over the entire range through the control of an oil control valve.

Therefore, when the cam followers are positioned to the forward end face 527*d*-side cam profile by driving a variable valve characteristic control device, the intake valves are not opened at all. Hence, it becomes possible to perform complete cylinder operation stop by completely closing the engine intake valves when necessary.

Furthermore, since the amount of lift alone can be changed without changing the valve opening/closing timing, it becomes possible to control the amount of intake air by using the intake valves.

If this embodiment is applied to an engine having two intake valves for each cylinder, an intake cam 527 as described above and an intake cam having a certain operation angle may be employed as the two intake cams for each cylinder. In this construction, by driving a variable valve characteristic control device, the two intake valves for each cylinder can be caused to provide different amounts of lift so as to provide different amounts of intake, so that swirl can be produced in each cylinder.

Although in the sixth embodiment, the intake cams have such a cam profile that the intake valves are not opened at all, the intake valves and the exhaust cams may have such a cam profile that the intake valves and the exhaust valves remain completely closed. This construction realizes further complete cylinder operation stop. It is also possible to adopt a construction in which only the exhaust valves have such a cam profile that the exhaust valves are not opened at all, in order to realize complete cylinder operation stop.

Figure 18:
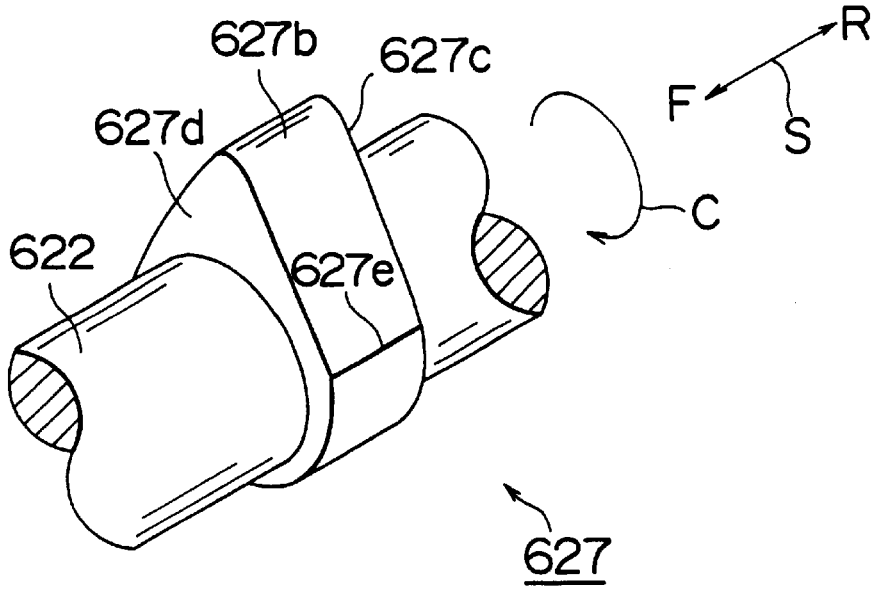
FIG. 18 is a perspective view of an intake cam according to a seventh embodiment.

A seventh embodiment of the invention will be described with reference to FIG. 18, which differs from the first embodiment only in the cam configuration (profiles) of intake cams 627. In FIG. 18, each intake cam 627 has a main nose 627*b* and a sub-nose 627*e* that is formed on a valve-opening side.

Figure 19A:
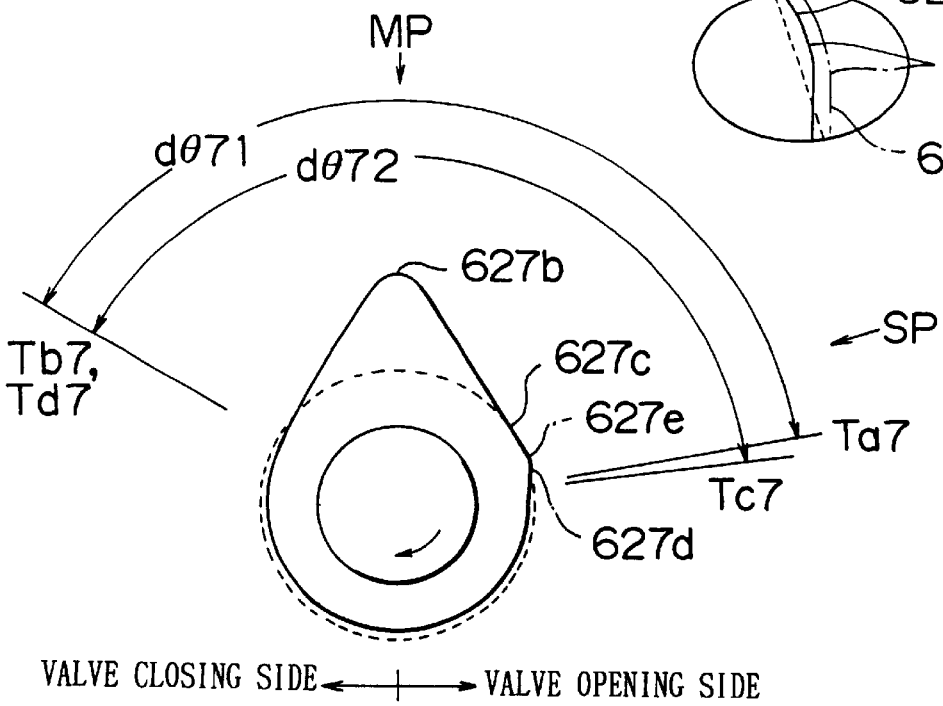
FIG. 19A is an illustration of cam profiles of the intake cam of the seventh embodiment.
Figure 19B:
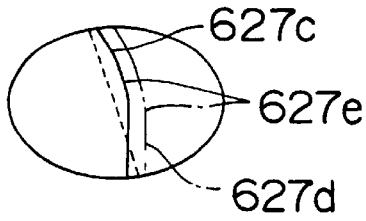
FIG. 19B is an enlarged partial view of the intake cam shown in FIG. 19A.

Referring to FIGS. 19A and 19B (enlarged partial view), the height of the sub-nose 627*e* is increased on the side of a forward end face 627*d* (indicated by a one-dot chain line). The height of the sub-nose 627*e* gradually decreases as the distance to a rearward end face 627*c* (indicated by a solid line) decreases. The profile of the other portions, including the main nose 627*b*, does not vary between the forward end face 627*d* and the rearward end face 627*c*. Due to the different heights of the sub-nose 627*e*, the valve opening timing Tc7 determined by the forward end face 627*d*-side cam profile is advanced from the valve opening timing Ta7 determined by the rearward end face 627*c*-side cam profile. The valve closing timings Tb7, Td7 determined by the two end cam profiles are the same.

Figure 20:
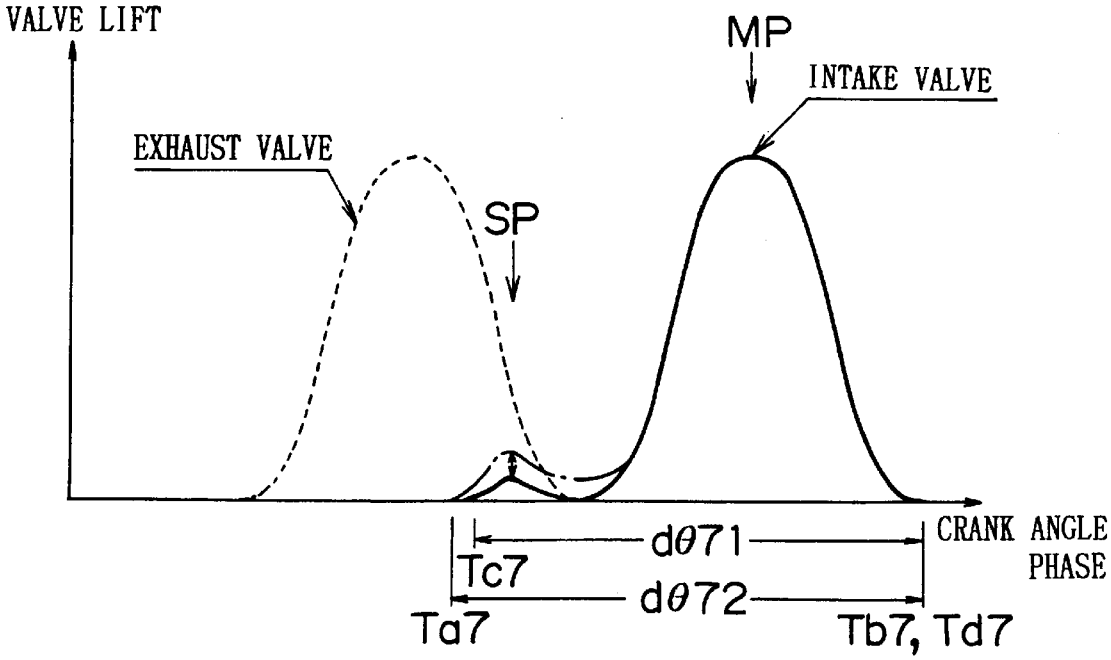
FIG. 20 is a graph indicating lift patterns achieved by the intake cam of the seventh embodiment.

Thus, each intake cam 627 has, on the sides of the end faces 627*c*, 627*d* along the rotating axis, the two cam profiles determining two different lift patterns as described above. In an intermediate portion between the two end faces, the cam profile continuously varies from one of the two cam profiles to the other cam profile. Therefore, the lift pattern of the intake valves can be varied continuously between the first lift pattern having a main peak MP and a relatively low sub-peak SP as indicated by a solid line in FIG. 20 and the second lift pattern having the main peak MP and a relatively high sub-peak SP as indicated by a one-dot chain line in FIG. 20, through the control of an oil control valve.

Provision of a sub-peak SP in a lift pattern as described above forms a trough between the sub-peak SP and the main peak MP such that the intake valves are prevented from interfering with the corresponding pistons. Therefore, it becomes possible to increase the internal EGR without a danger of interference between the intake valves and the pistons.

Furthermore, the valve opening timing can be adjusted by adjusting the amount of lift at the sub-peak SP. Therefore, as in the first embodiment, it becomes possible to realize a combustion stability during idling, a reduction of the pump loss, sufficient internal EGR due to the valve overlap in accordance with the operational condition of the engine 11, and the like.

The above-described cam configuration (profiles) may also be applied to exhaust cams.

Figure 21:
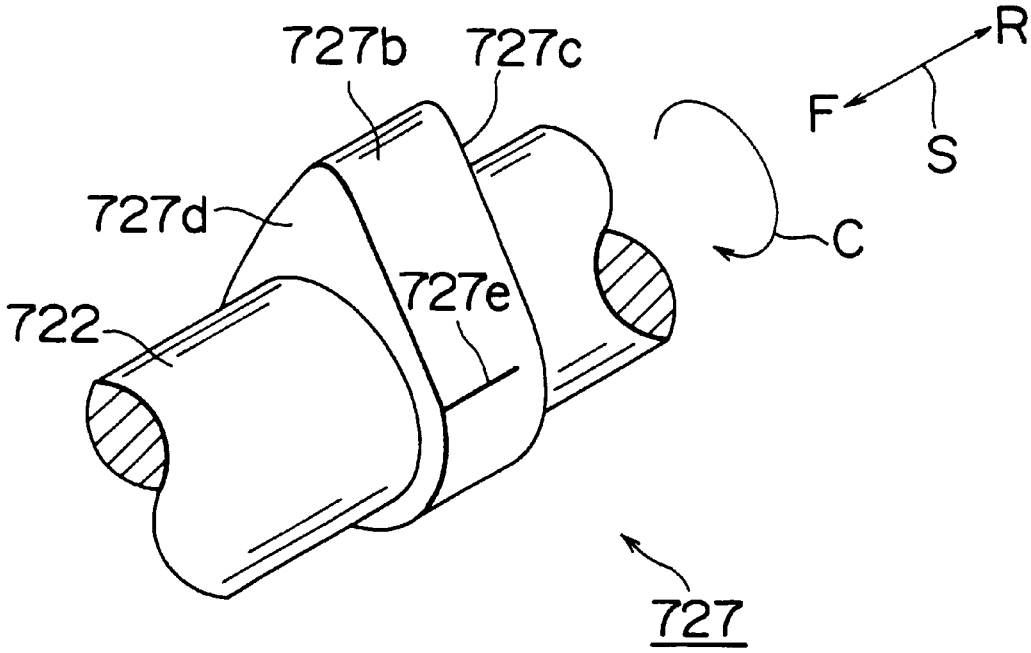
FIG. 21 is a perspective view of an intake cam according to an eighth embodiment of the invention.

An eighth embodiment of the invention will be described with reference to FIG. 21, which differs from the first embodiment only in the cam configuration (profiles) of intake cams 727.

Figure 22:
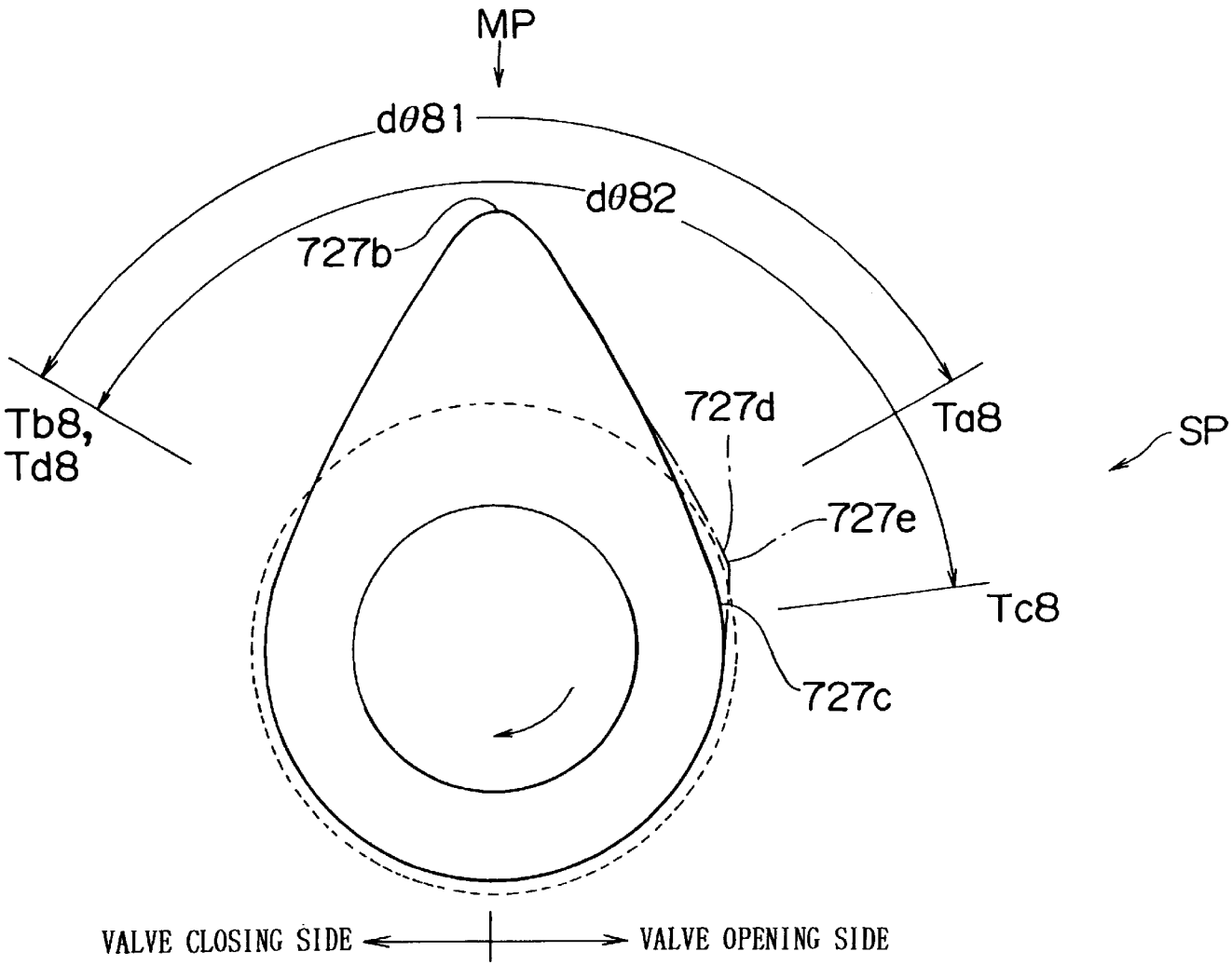
FIG. 22 is an illustration of cam profiles of the intake cam of the eighth embodiment.

The intake cam 727 has, on the side of a forward end face 727*d* indicated by a one-dot chain line in FIG. 22, a main nose 727*b* and a sub-nose 727*e* that is formed on a valve-opening side. On the side of a rearward end face 727*c* indicated by a solid line in FIG. 22, the sub-nose 727*e* substantially disappears. The profile of the other portions does not vary between the forward end face 727*d* and the rearward end face 727*c*. Due to the formation of the sub-nose 727*e*, the valve opening timing Tc8 determined by the forward end face 727*d*-side cam profile is advanced from the valve opening timing Ta8 determined by the rearward end face 727*c*-side cam profile. The valve closing timings Tb8, Td8 determined by the two end cam profiles are the same.

Figure 23:
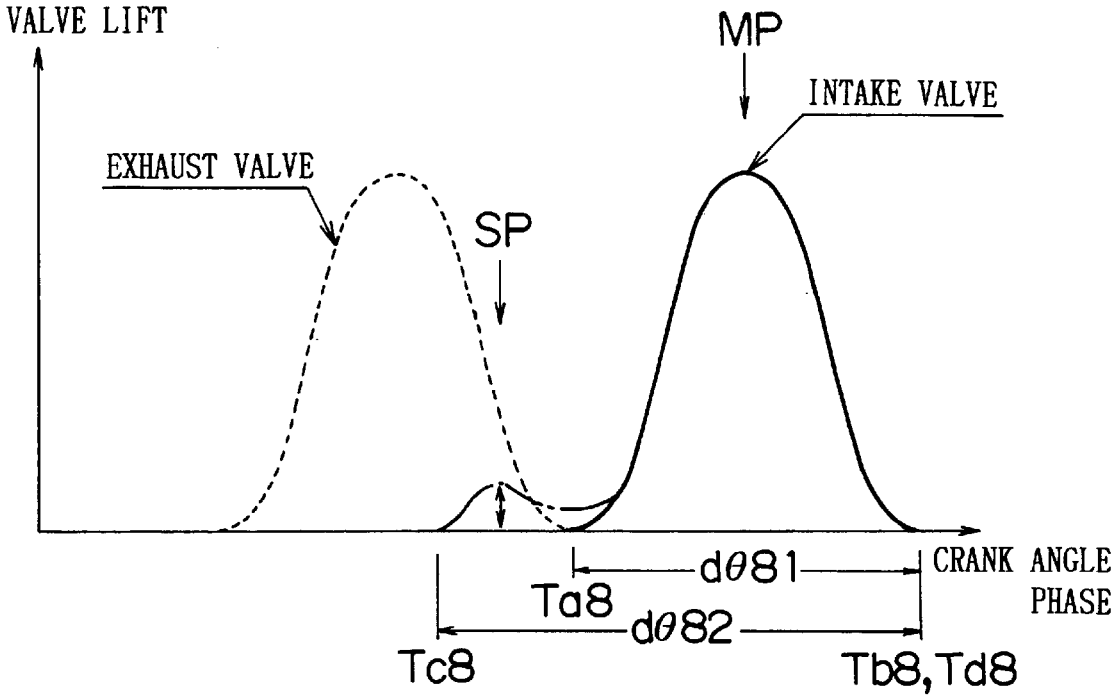
FIG. 23 is a graph indicating lift patterns achieved by the intake cam of the eighth embodiment.

Thus, each intake cam 727 has, on the sides of the end faces 727*c*, 727*d* along the rotating axis, the aforementioned two cam profiles determining two different lift patterns. In an intermediate portion between the two end faces, the cam profile continuously varies from one of the two cam profiles to the other cam profile. Therefore, the lift pattern of the intake valves can be varied continuously between the first lift pattern having a main peak MP alone as indicated by a solid line in FIG. 23 and the second lift pattern having the main peak MP and a sub-peak SP as indicated by a one-dot chain line in FIG. 23, through the control of an oil control valve.

Provision of a sub-peak SP in a lift pattern as described above forms a trough between the sub-peak SP and the main peak MP such that the intake valves are prevented from interfering with the corresponding pistons. Therefore, it becomes possible to increase the internal EGR without a danger of interference between the intake valves and the pistons, by changing the lift pattern from the lift pattern with no sub-peak SP to a lift pattern with a sub-peak SP as needed.

Furthermore, the valve opening timing can be adjusted by adjusting the amount of lift at the sub-peak SP or selecting a lift pattern with or without the sub-peak SP.

The above-described cam configuration (profiles) may also be applied to exhaust cams.

Figure 24:
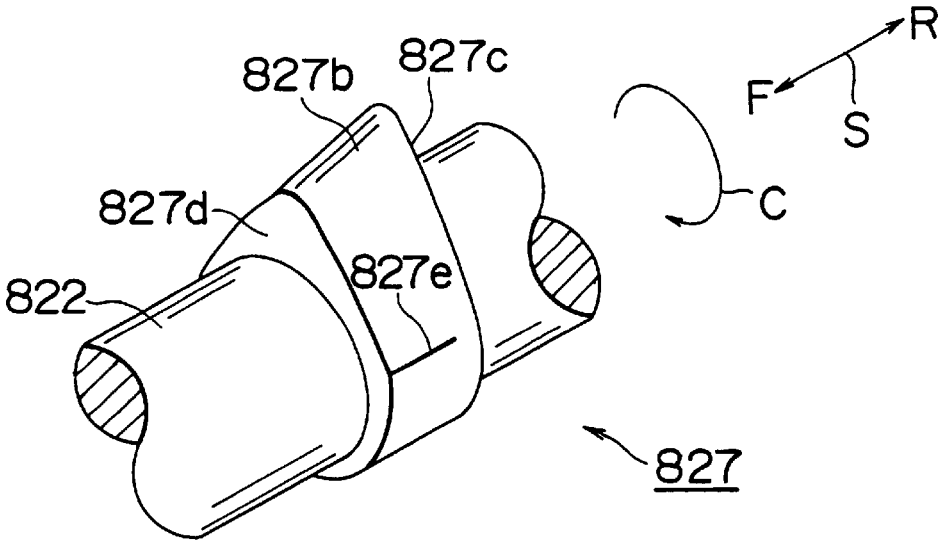
FIG. 24 is a perspective view of an intake cam according to a ninth embodiment of the invention.

A ninth embodiment of the invention will be described with reference to FIG. 24, which differs from the first embodiment only in the cam configuration (profiles) of intake cams 827.

Figure 25:
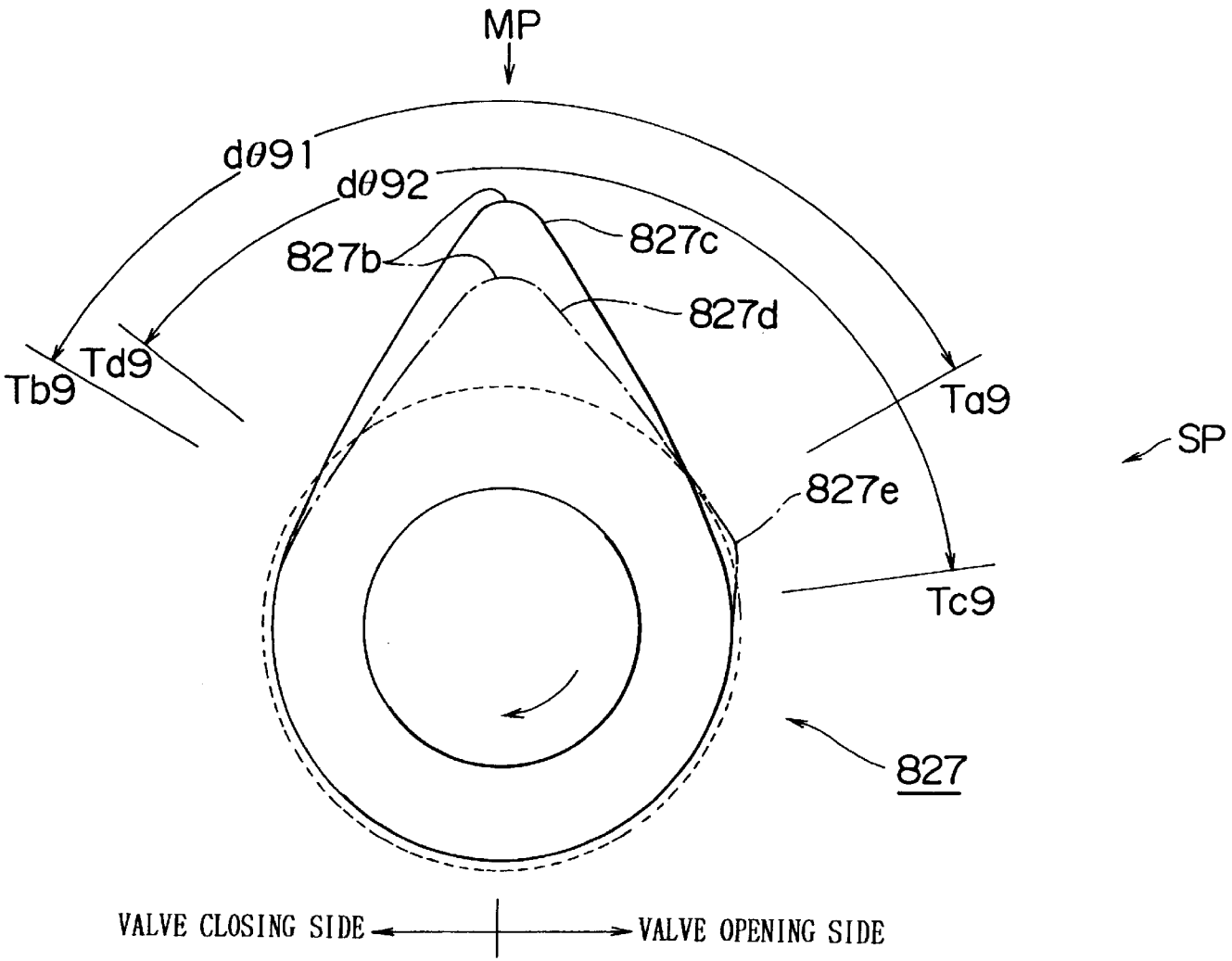
FIG. 25 is an illustration of cam profiles of the intake of the ninth embodiment.

The intake cam 827 has, on the side of a forward end face 827*d* indicated by a one-dot chain line in FIG. 25, a main nose 827*b* and a sub-nose 827*e* that is formed on a valve-opening side. On the side of a rearward end face 827*c* indicated by a solid line in FIG. 25, the sub-nose 827*e* substantially disappears. Although the configuration of the sub-nose 827*e* is substantially the same as that in the eighth embodiment, the ninth embodiment differs in that the main nose 827*b* is lower on the side of the forward end face 827*d* than on the side of the rearward end face 827*c*.

Due to the above-described configuration of the main nose 827*b* and the sub-nose 827*e*, the valve opening timing Tc9 and the valve closing timing Td9 determined by the forward end face 827*d*-side cam profile are advanced from the valve opening timing Ta9 and the valve closing timing Tb9 determined by the rearward end face 827*c*-side cam profile, respectively.

Figure 26:
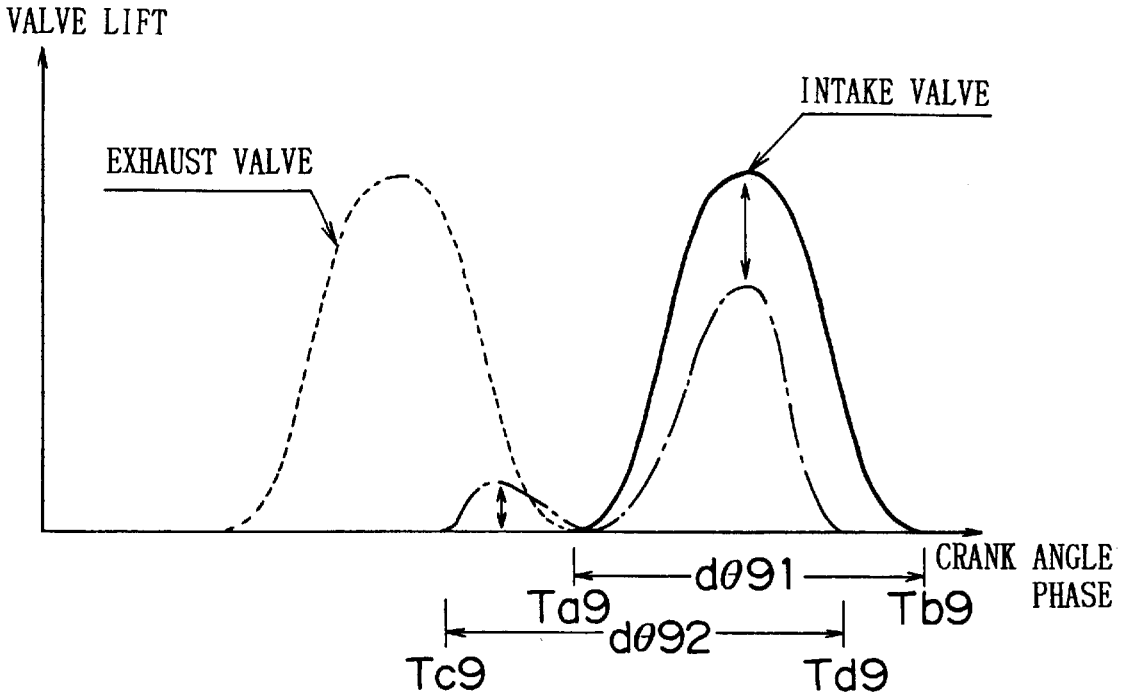
FIG. 26 is a graph indicating lift patterns achieved by the intake cam of the ninth embodiment.

Thus, each intake cam 827 has, on the sides of the end faces 827*c*, 827*d* along the rotating axis, the aforementioned two cam profiles determining two different lift patterns. In an intermediate portion between the two end faces, the cam profile continuously varies from one of the two cam profiles to the other cam profile. Therefore, the lift pattern of the intake valves can be varied continuously between the first lift pattern having a main peak MP alone as indicated by a solid line in FIG. 26 and the second lift pattern having the main peak MP and a sub-peak SP as indicated by a one-dot chain line in FIG. 26, through the control of an oil control valve.

Since the variation of the amount of lift at the main peak MP is opposite in direction to the variation of the amount of lift at the sub-peak SP, the valve opening timing and the valve closing timing can be simultaneously advanced or delayed. Therefore, the opening and closing timings of the intake valves can be advanced or delayed without greatly changing the width of the valve operation angle. As a result, it becomes possible to simultaneously advance or delay the valve opening timing and the valve closing timing while maintaining a suitable compression rate and a suitable volume efficiency based on a proper valve operation angle width. Hence, this embodiment makes it possible to realize a combustion stability during idling, a reduction of the pump loss, sufficient internal EGR due to the valve overlap in accordance with the operational condition of the engine, and the like.

The above-described cam configuration (profiles) may also be applied to exhaust cams.

Figure 27:
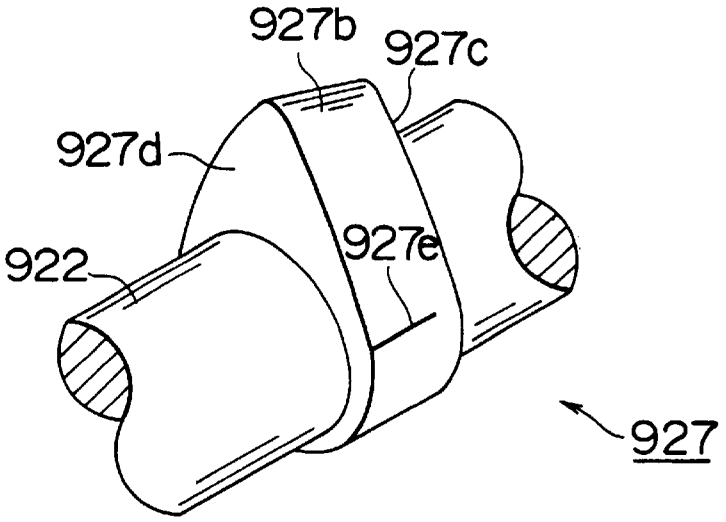
FIG. 27 is a perspective view of an intake cam according to a tenth embodiment of the invention.

A tenth embodiment will be described with reference to FIG. 27, which differs from the first embodiment only in the cam configuration (profiles) of intake cams 927.

Figure 28:
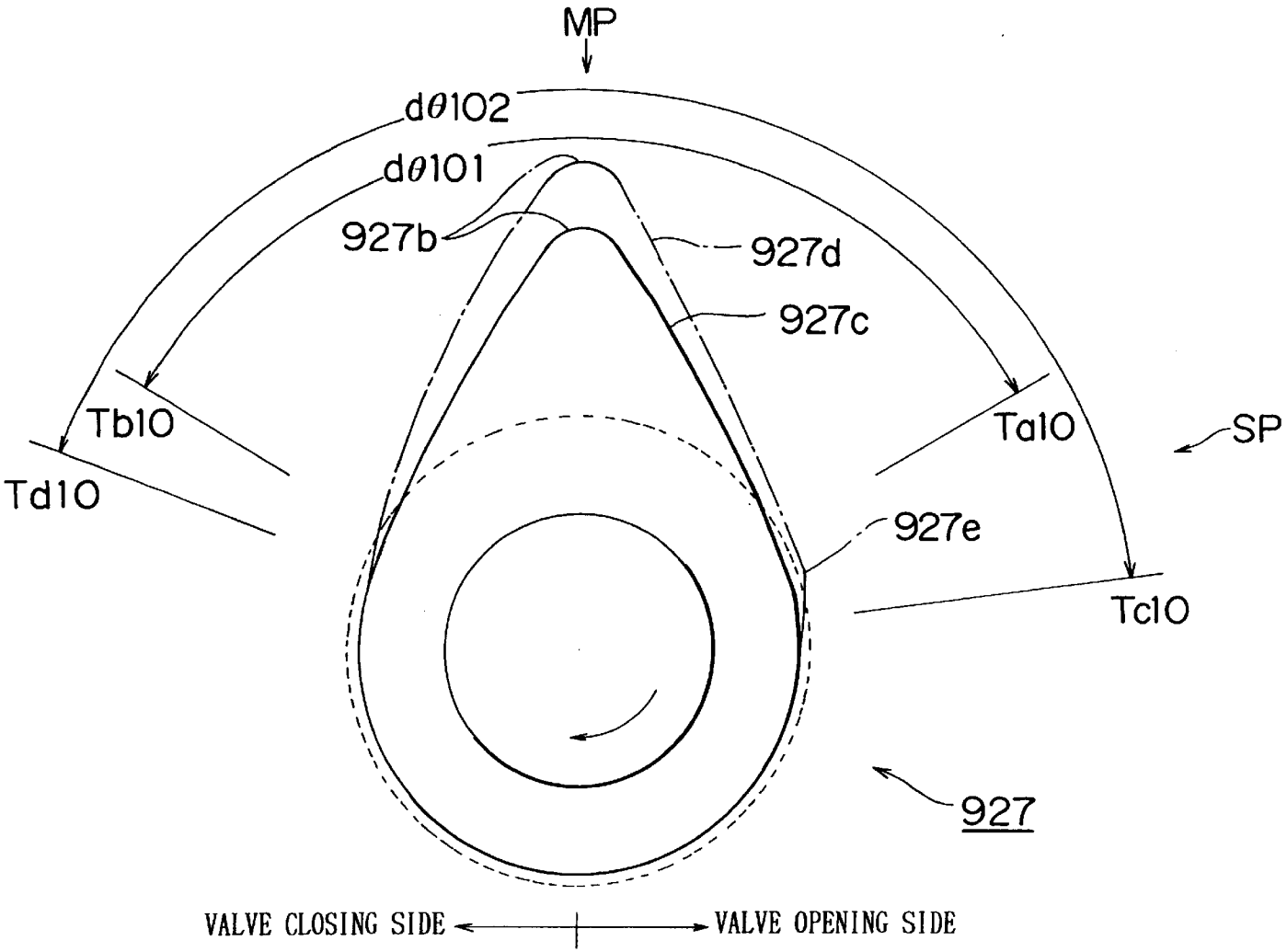
FIG. 28 is an illustration of cam profiles of the intake cam of the tenth embodiment.

The intake cam 927 has, on the side of a forward end face 927*d* indicated by a one-dot chain line in FIG. 28, a main nose 927*b* and a sub-nose 927*e* that is formed on a valve-opening side. On the side of a rearward end face 927*c* indicated by a solid line in FIG. 28, the sub-nose 927*e* substantially disappears. Although the configuration of the sub-nose 927*e* is substantially the same as that in the eighth embodiment, the tenth embodiment differs in that the main nose 927*b* is higher on the side of the forward end face 927*d* than on the side of the rearward end face 927*c*.

Due to the above-described configuration of the main nose 927*b* and the sub-nose 927*e*, the valve opening timing Tc10 determined by the forward end face 927*d*-side cam profile is advanced from the valve opening timing Ta10 determined by the rearward end face 927*c*-side cam profile, and the valve closing timing Td10 determined by the forward end face 927*d*-side cam profile is delayed from the valve closing timing Tb10 determined by the rearward end face 927*c*-side cam profile.

Figure 29:
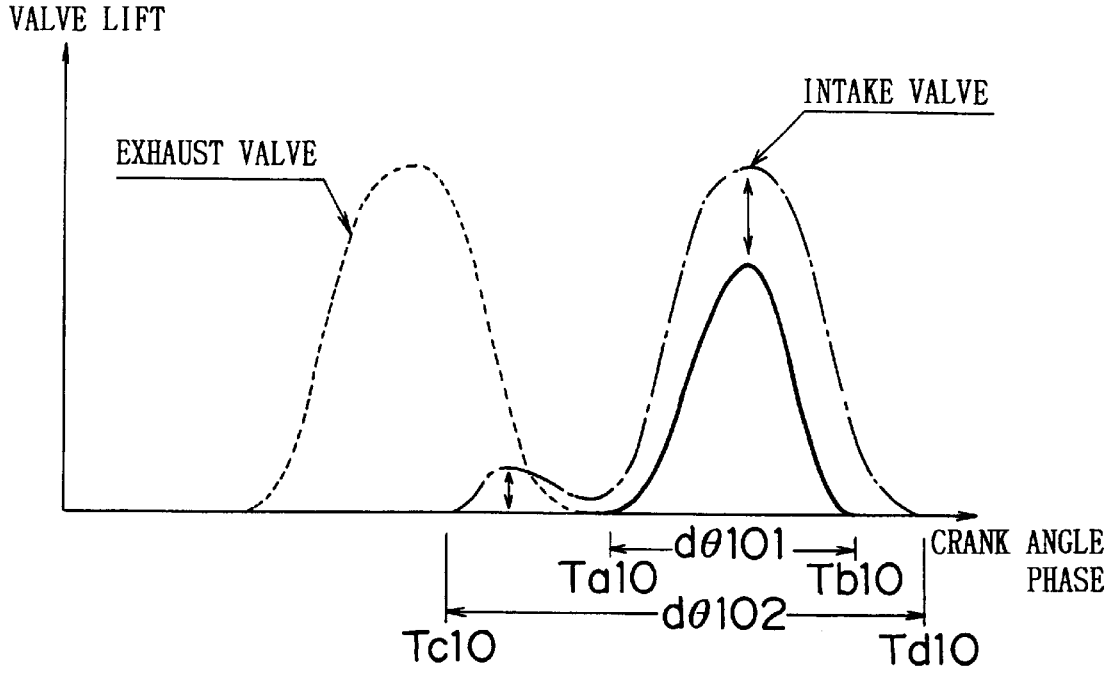
FIG. 29 is a graph indicating lift patterns achieved by the intake cam of the tenth embodiment.
Figure 30:
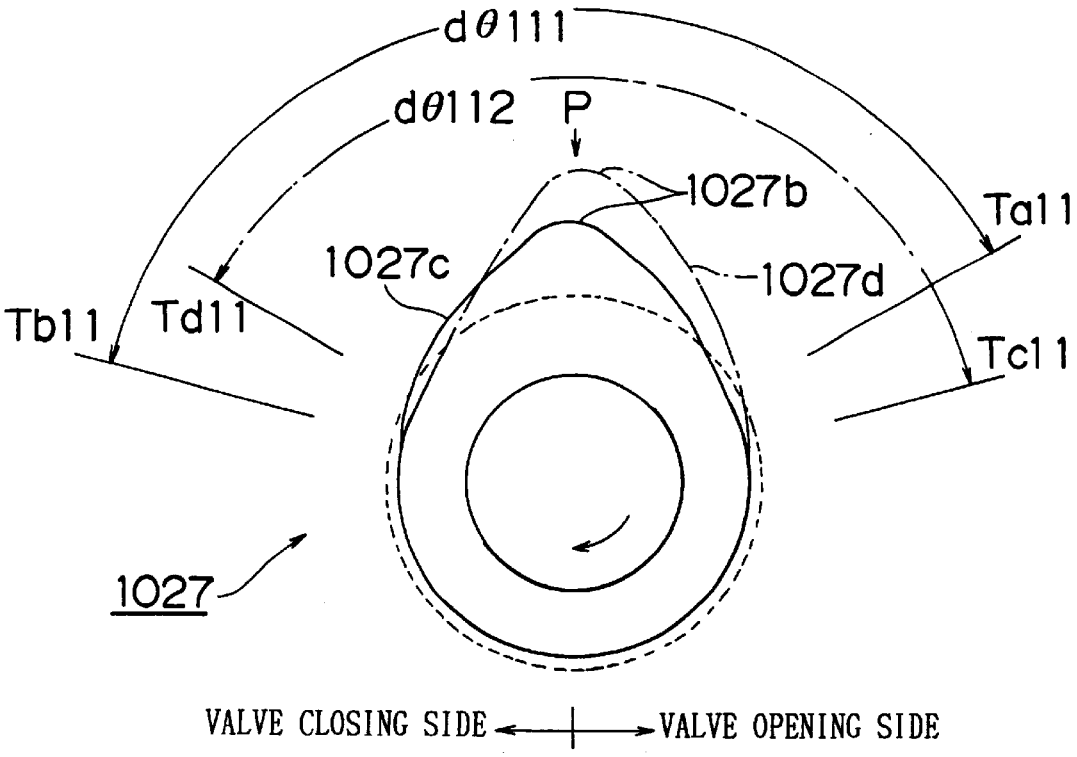
FIG. 30 is an illustration of cam profiles of the intake cam of an eleventh embodiment of the invention.

Thus, each intake cam 927 has, on the sides of the end faces 927*c*, 927*d* along the rotating axis, the aforementioned two cam profiles determining two different lift patterns. In an intermediate portion between the two end faces, the cam profile continuously varies from one of the two cam profiles to the other cam profile. Therefore, the lift pattern of the intake valves can be varied continuously between the first lift pattern having a main peak MP alone as indicated by a solid line in FIG. 29 and the second lift pattern having the main peak MP and a sub-peak SP as indicated by a one-dot chain line in FIG. 29, through the control of an oil control valve.

A shift from the rearward end face 927*c*-side cam profile toward the forward end face 927*d*-side cam profile increases the amount of lift at the main peak MP and the amount of lift at the sub-peak SP, and changes the valve operation angle from a small valve operation angle dθ101 to a great valve operation angle dθ102. Therefore, large amounts of air can be introduced into the cylinders while the intake valves are prevented from interfering with the pistons. As a result, the engine output performance can be further improved.

The above-described cam configuration (profiles) may also be applied to exhaust cams.

An eleventh embodiment of the invention will be described with reference to FIG. 28, which differs from the first embodiment only in the cam configuration (profiles) of intake cams 1027.

In the intake cam 1027, the height of a nose 1027*b* changes in the directions of a rotating axis of the intake cam 1027. The height of the nose 1027*b* is reduced on the side of a rearward end face 1027*c* (indicated by a solid line). A lift pattern on the side of the rearward end face 1027*c* is not symmetric. More specifically, a valve closing side portion of the rearward end face 1027*c*-side lift pattern is higher than a valve opening side portion of the lift pattern. The height of the nose 1027*b* is increased on the side of a forward end face 1027*d* (indicated by a one-dot chain line). A lift pattern on the side of the forward end face 1027*d* is not symmetric. More specifically, a valve opening side portion of the forward end face 1027*d*-side lift pattern is higher than a valve closing side portion of the lift pattern.

Figure 31:
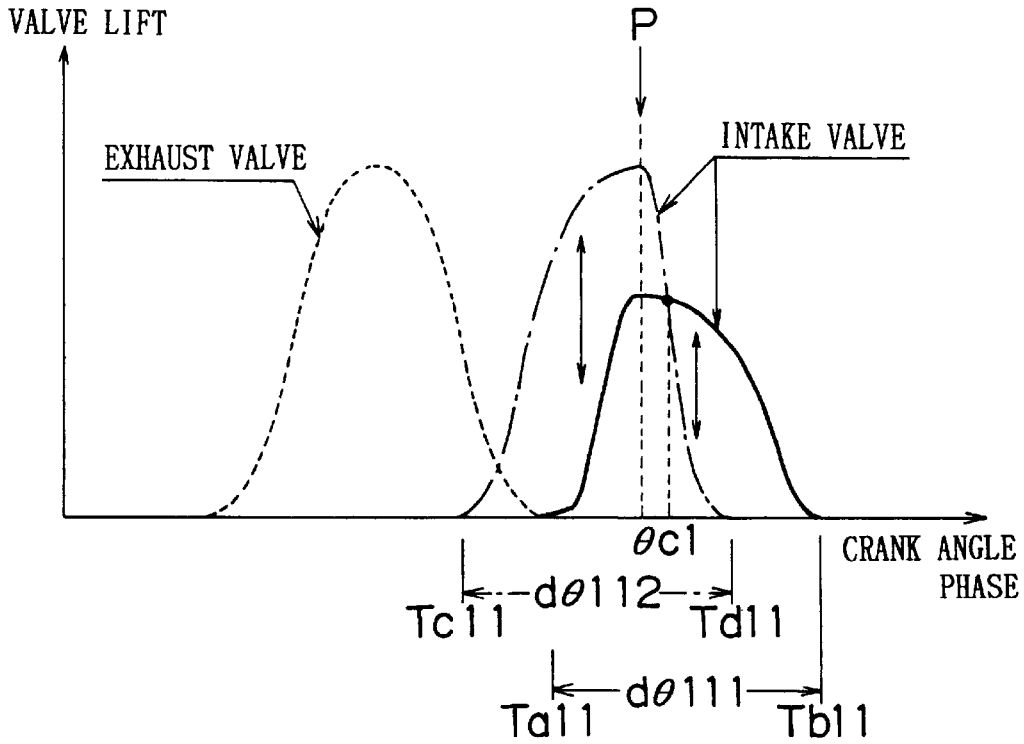
FIG. 31 is a graph indicating lift patterns achieved by the intake cam of the eleventh embodiment.

As indicated in a lift pattern diagram in FIG. 31, the rearward end face 1027*c*-side cam profile and the forward end face 1027*d*-side cam profile provide equal amounts of lift at a phase θc1. In the advance side of the phase θc1, the forward end face 1027*d*-side cam profile (one-dot chain line) provides greater amounts of lift than the rearward end face 1027*c*-side cam profile (solid line). In the delay side of the phase θc1, the rearward end face 1027*c*-side cam profile (solid line) provides greater amounts of lift than the forward end face 1027*d*-side cam profile (one-dot chain line).

Therefore, the intake valve opening timing Tc11 determined by the forward end face 1027*d*-side cam profile is advanced from the intake valve opening timing Ta11 determined by the rearward end face 1027*c*-side cam profile. Furthermore, the intake valve closing timing Td11 determined by the forward end face 1027*d*-side cam profile is advanced from the intake valve closing timing. Tb11 determined by the rearward end face 1027*c*-side cam profile.

The forward end face 1027*d*-side cam profile and the rearward end face 1027*c*-side cam profile achieve maximum amounts of lift, that is, peaks P, at the same phase. However, the amount of lift achieved at the peak P by the forward end face 1027*d*-side cam profile is greater than the amount of lift achieved at the peak P by the rearward end face 1027*c*-side cam profile.

The width of valve operation angle of the rearward end face 1027*c*-side cam profile and the width of valve operation angle of the forward end face 1027*d*-side cam profile are equal.

Thus, each intake cam 1027 has, on the sides of the end faces 1027*c*, 1027*d* in the directions of the rotating axis, the aforementioned two cam profiles determining two different lift patterns. In an intermediate portion between the two end faces, the cam profile continuously varies from one of the two cam profiles to the other cam profile. Therefore, the lift pattern of the intake valves can be varied continuously between the first lift pattern indicated by the solid line in FIG. 31 and the second lift pattern indicated by the one-dot chain line in FIG. 31, through the control of an oil control valve.

In this lift pattern changing control, the amount of lift of the intake valves at the peak P is adjusted and the valve opening timing and the valve closing timing are changed in the same direction while the operation angle width of the intake valves is maintained. Although the valve opening and closing timings and the amount of lift at the peak P are changed, the position (phase) of the peak P of the intake valves is not changed.

Thus, this embodiment is able to adjust the amount of lift of the intake valves at the peak P and simultaneously advance or delay the opening timing and the closing timing of the intake valves without changing the valve operation angle width. Therefore, it is possible to adjust the amount of lift at the peak P and simultaneously advance or delay the valve opening and closing timings while maintaining a suitable compression rate and a suitable volume efficiency based on an appropriate valve operation angle width. Hence, it becomes possible to adjust the combustion characteristic of the engine in a further minute manner in accordance with the operational condition of the engine.

Figure 32:
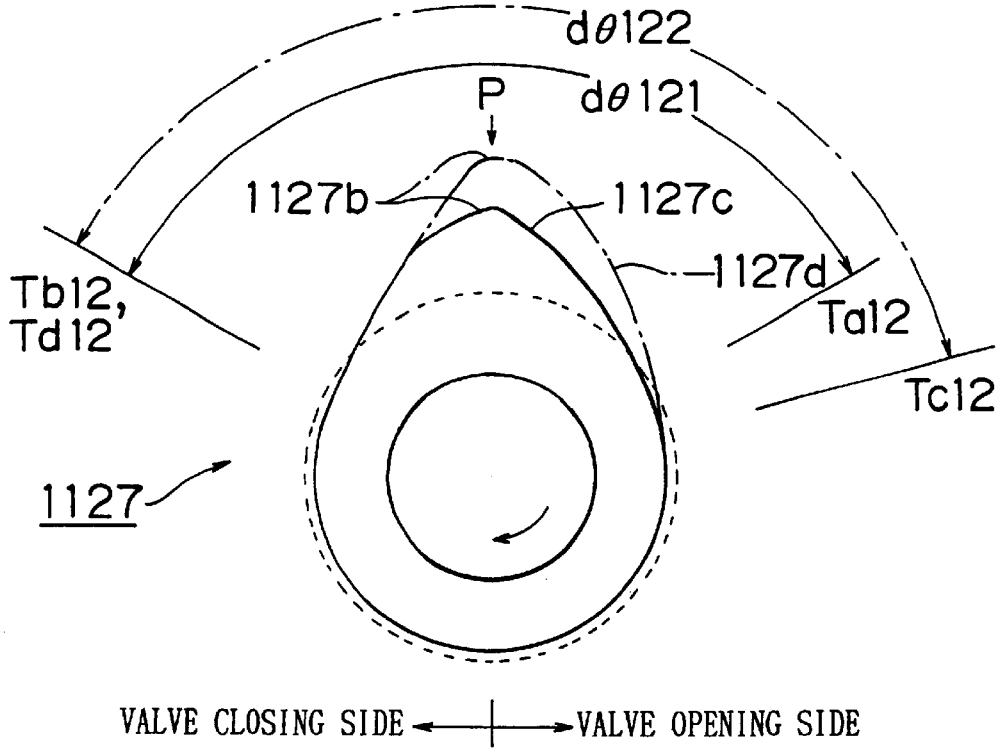
FIG. 32 is an illustration of cam profiles of the intake cam of a twelfth embodiment of the invention.

A twelfth embodiment of the invention will be described with reference to FIG. 32, which differs from the first embodiment only in the cam configuration (profiles) of intake cams 1127.

In the intake cam 1127, the height of a nose 1127*b* changes along a rotating axis of the intake cam 1127. The height of the nose 1127*b* is reduced on the side of a rearward end face 1127*c* indicated by a solid line in FIG. 32. A lift pattern on the side of the rearward end face 1127*c* is substantially symmetric. The height of the nose 1127*b* is increased on the side of a forward end face 1127*d* indicated by a one-dot chain line in FIG. 32. A lift pattern on the side of the forward end face 1127*d* is formed as follows. That is, a valve opening side portion of the forward end face 1127*d*-side lift pattern is higher than a valve closing side portion of the lift pattern.

Figure 33:
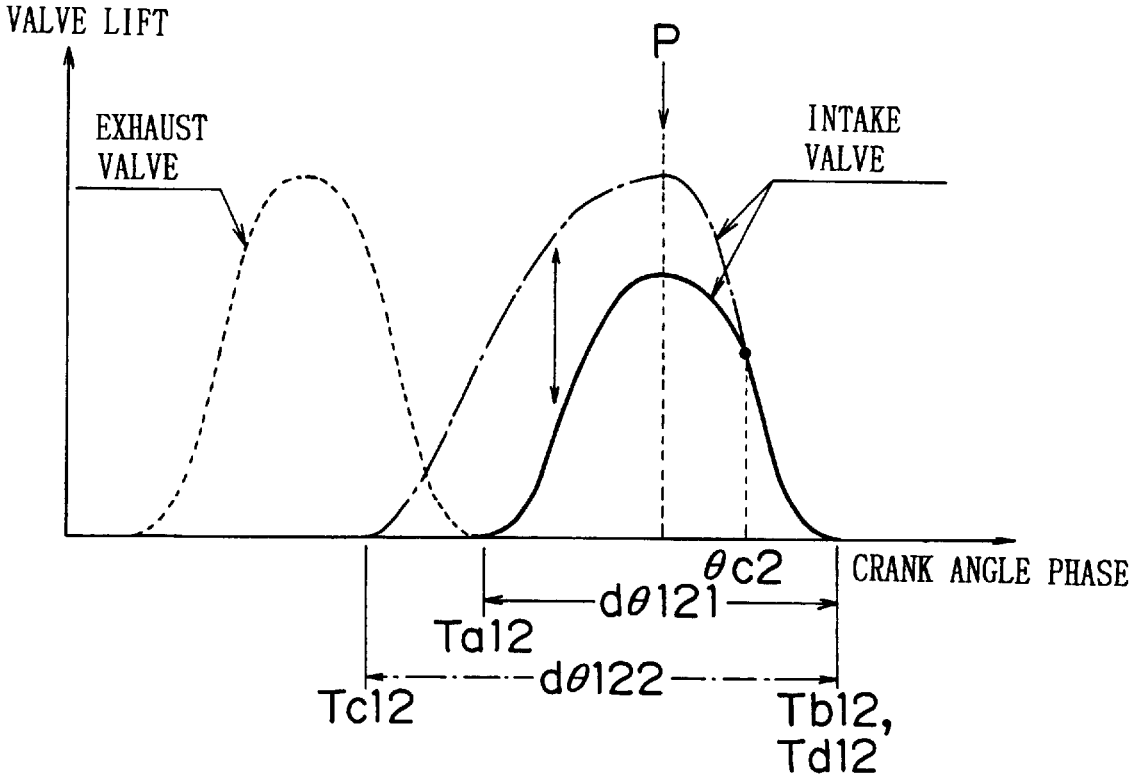
FIG. 33 is a graph indicating lift patterns achieved by the intake cam of the twelfth embodiment.
Figure 34:
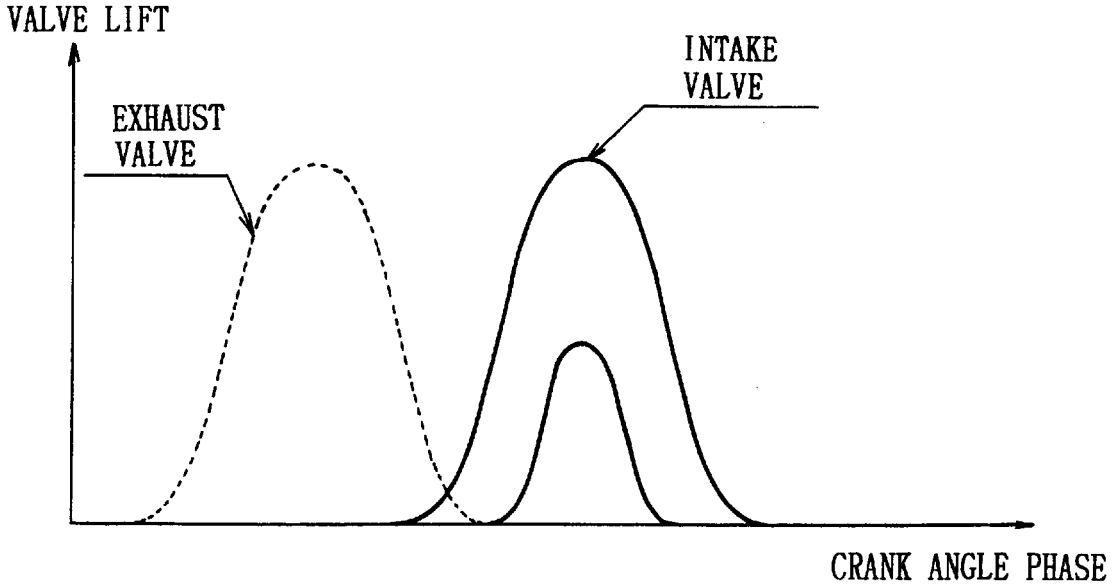
FIG. 34 RELATED ART
FIG. 34 is a graph indicating lift patterns achieved by a related art intake cam.

As indicated in a lift pattern diagram in FIG. 33, the rearward end face 1127*c*-side cam profile and the forward end face 1127*d*-side cam profile provide different amounts of lift only in the advance side of a phase θc2. In the advance side of the phase θc2, the forward end face 1127*d*-side cam profile (one-dot chain line) provides greater amounts of lift than the rearward end face 1127*c*-side cam profile (solid line).

Therefore, the intake valve opening timing Tc12 determined by the forward end face 1127*d*-side cam profile is advanced from the intake valve opening timing Ta12 determined by the rearward end face 1127*c*-side cam profile.

However, the intake valve closing timing Td12 determined by the forward end face 1127*d*-side cam profile and the intake valve closing timing Tb12 determined by the rearward end face 1127*c*-side cam profile are the same.

The forward end face 1127*d*-side cam profile and the rearward end face 1127*c*-side cam profile achieve maximum amounts of lift, that is, peaks P, at the same phase. However, the amount of lift achieved at the peak P by the forward end face 1127*d*-side cam profile is greater than the amount of lift achieved at the peak P by the rearward end face 1127*c*-side cam profile. In the advance side of the phase θc2, the forward end face 1127*d*-side lift pattern and the rearward end face 1127*c*-side lift pattern provide different amounts of lift; more specifically, the forward end face 1127*d*-side lift pattern is higher than the rearward end face 1127*c*-side lift pattern. In the delay side of the phase θc2, the rearward end face 1127*c*-side lift pattern and the forward end face 1127*d*-side lift pattern coincide. Therefore, the valve operation angle dθ122 determined by the forward end face 1127*d*-side lift pattern is expanded on the advance side, in comparison with the valve operation angle dθ121 determined by the rearward end face 1127*c*-side lift pattern.

Thus, each intake cam 1127 has, on the sides of the end faces 1127*c*, 1127*d* in the directions of the rotating axis, the aforementioned two cam profiles determining two different lift patterns. In an intermediate portion between the two end faces, the cam profile continuously varies from one of the two cam profiles to the other cam profile. Therefore, the lift pattern of the intake valves can be varied continuously between the first lift pattern indicated by the solid line in FIG. 33 and the second lift pattern indicated by the one-dot chain line in FIG. 33, through the control of an oil control valve.

In this lift pattern changing control, the amount of lift of the intake valves at the peak P and the opening timing of the intake valves are changed while the closing timing of the intake valves is maintained. Although the valve opening timing and the amount of lift at the peak P are changed, the position (phase) of the peak P of the intake valves is not changed.

Thus, this embodiment is able to simultaneously change the amount of lift at the peak P and the opening timing of the intake valves without changing the peak position nor the closing timing thereof. Therefore, it is possible to adjust the amount of lift at the peak P and advance or delay the valve opening timing while maintaining a suitable compression rate and a suitable volume efficiency based on an appropriate valve closing timing. Hence, it becomes possible to adjust the combustion characteristic of the engine in a further minute manner in accordance with the operational condition of the engine.

The foregoing embodiments of the invention employ intake (or exhaust) cams each having two different lift patterns, so that the phase at which the two lift patterns provide equal amounts of lift and the different amounts of lift provided by the two lift patterns in phases other than that phase can be set in accordance with the characteristics of the engine. Therefore, it becomes possible to achieve conformation to the characteristics of the engine and constantly realize a suitable valve characteristic in accordance with the operational condition of the engine. Therefore, improvements can be achieved in the output performance of the engine, the fuel consumption, and the combustion stability, and the like.

The foregoing embodiments, in the switching of the lift pattern through the use of the variable valve characteristic control device 24, continuously change the cam profile between the two lift patterns by shifting the three-dimensional intake (exhaust) cams in the directions of the rotating axis of the intake cams. Therefore, the valve characteristic can be controlled with high precision in accordance with the operational condition of the engine.

In the foregoing embodiments, the cam profile may also be changed stepwise between the two lift patterns. Furthermore, more than two lift patterns may also be used.

In the embodiments, the camshaft may also be relatively rotated when the camshaft is moved in a direction of the rotating axis of the camshaft. In this case, the camshaft normally has a cam profile that is predetermined taking into consideration the relative rotation of the camshaft.

While the present invention has been described with reference to what are presently considered to be preferred embodiments thereof, it is to be understood that the present invention is not limited to the disclosed embodiments or constructions. On the contrary, the present invention is intended to cover various modifications and equivalent arrangements.

What is claimed is:

1. A variable valve characteristic control apparatus of an internal combustion engine, comprising:

a cam having a cam profile that varies at least between a first lift pattern and a second lift pattern; and a controller that controls a valve characteristic of at least one of an intake valve and an exhaust valve of the internal combustion engine by adjusting a position of the cam along a rotating axis of the cam, wherein a valve lift provided by the second lift pattern within a valve operation angle of the first lift pattern is zero.

2. A variable valve characteristic control apparatus of an internal combustion engine, comprising:

a cam having a cam profile that varies at least between a first lift pattern and a second lift pattern; and a controller that controls a valve characteristic of at least one of an intake valve and an exhaust valve of the internal combustion engine by adjusting a position of the cam along a rotating axis of the cam, wherein the first lift pattern has at least two peaks, and a number of peaks of the second lift pattern is equal to or less than a number of the peaks of the first lift pattern.

3. A variable valve characteristic control apparatus according to claim 2, wherein an amount of lift provided by the first lift pattern at a sub-peak, that is different from a main peak at which the amount of lift becomes maximum, is smaller than an amount of lift provided at a sub-peak by the second lift pattern.

4. A variable valve characteristic control apparatus according to claim 3, wherein the amount of lift provided at the main peak by the first lift pattern is smaller than the amount of lift provided at a main peak by the second lift pattern.

5. A variable valve characteristic control apparatus according to claim 3, wherein the amount of lift provided at the main peak by the first lift pattern is greater than the amount of lift provided at a main peak by the second lift pattern.

6. A three-dimensional cam for use for at least one of an intake valve and an exhaust valve of an internal combustion engine, the three-dimensional cam having a cam profile that continuously varies, comprising:

a first lift pattern; and a second lift pattern in which a valve lift provided within a valve operation angle is zero.

7. A three-dimensional cam for use for at least one of an intake valve and an exhaust valve of an internal combustion engine, the three-dimensional cam having a cam profile that continuously varies, comprising:

a first lift pattern having at least two peaks; and a second lift pattern having a number of peaks that is equal to or less than a number of the peaks of the first lift pattern.

8. A three-dimensional cam according to claim 7, wherein an amount of lift provided by the first lift pattern at a sub-peak, that is different from a main peak at which the amount of lift becomes maximum, is smaller than an amount of lift provided at a sub-peak by the second lift pattern.

9. A three-dimensional cam according to claim 8, wherein the amount of lift provided at the main peak by the first lift pattern is smaller than the amount of lift provided at a main peak by the second lift pattern.

10. A three-dimensional cam according to claim 8, wherein the amount of lift provided at the main peak by the first lift pattern is greater than the amount of lift provided at a main peak by the second lift pattern.

* * * * *